US012410023B2

(12) United States Patent
Shimosaka et al.

(10) Patent No.: US 12,410,023 B2
(45) Date of Patent: Sep. 9, 2025

(54) MEDIUM CONVEYING APPARATUS

(71) Applicant: PFU LIMITED, Kahoku (JP)

(72) Inventors: Kiichiro Shimosaka, Kahoku (JP); Syuichi Morikawa, Kahoku (JP)

(73) Assignee: PFU LIMITED, Kahoku (JP)

( * ) Notice: Subject to any disclaimer, the term of this patent is extended or adjusted under 35 U.S.C. 154(b) by 32 days.

(21) Appl. No.: 18/589,111

(22) Filed: Feb. 27, 2024

(65) Prior Publication Data

US 2024/0199358 A1 Jun. 20, 2024

Related U.S. Application Data

(63) Continuation of application No. PCT/JP2021/034164, filed on Sep. 16, 2021.

(51) Int. Cl.

| | |
|---|---|
| ***B65H 1/26*** | (2006.01) |
| *B65H 1/02* | (2006.01) |
| *B65H 1/06* | (2006.01) |

(52) U.S. Cl.

CPC ..... *B65H 1/26* (2013.01); *B65H 1/027* (2013.01); *B65H 1/06* (2013.01); *B65H 2402/10* (2013.01);

(Continued)

(58) Field of Classification Search

CPC ..... B65H 1/027; B65H 1/26; B65H 2402/10; B65H 2402/30; B65H 2402/31;

(Continued)

(56) References Cited

U.S. PATENT DOCUMENTS

| | | | | |
|---|---|---|---|---|
| 8,820,742 | B2 * | 9/2014 | Koyanagi | B65H 31/24 271/224 |
| 2018/0194579 | A1 * | 7/2018 | Harada | B65H 3/523 |
| 2024/0391715 | A1 * | 11/2024 | Shimosaka | B65H 5/06 |

FOREIGN PATENT DOCUMENTS

| | | | |
|---|---|---|---|
| JP | S61-95732 | U | 6/1986 |
| JP | H04-338052 | A | 11/1992 |

(Continued)

OTHER PUBLICATIONS

International Search Report dated Oct. 12, 2021 for corresponding PCT Application No. PCT/JP2021/034164 (3 pages) with English Translation (2 pages).

(Continued)

*Primary Examiner* — Michael McCullough
(74) *Attorney, Agent, or Firm* — WOMBLE BOND DICKINSON (US) LLP

(57) ABSTRACT

A medium conveying apparatus includes: a housing having an engaged portion and a guide surface; a placement tray having an engaging portion and a placement surface; and a side guide mounted on the placement surface and protruding downstream beyond the placement tray to restrict a medium in a width direction. The engaged portion restricts entry or removal of the engaging portion when the placement surface forms a first angle with the guide surface, and allows entry or removal of the engaging portion when the placement surface forms a second angle different from the first angle with the guide surface in attachment of the placement tray to the housing or detachment of the placement tray from the housing. A downstream end of the side guide in the conveying direction does not intersect with the guide surface as viewed from the width direction when the placement surface forms the second angle.

6 Claims, 18 Drawing Sheets

(52) U.S. Cl.
CPC ..... *B65H 2402/31* (2013.01); *B65H 2402/53* (2013.01); *B65H 2405/32* (2013.01); *B65H 2801/12* (2013.01)

(58) Field of Classification Search
CPC ..... B65H 2402/33; B65H 2405/31; B65H 2405/32; G03G 2215/00392
See application file for complete search history.

(56) References Cited

FOREIGN PATENT DOCUMENTS

| | | | | |
|---|---|---|---|---|
| JP | H06-9115 | A | | 1/1994 |
| JP | 2002308511 | A | * | 10/2002 |
| JP | 2007-276908 | A | | 10/2007 |
| JP | 2010-235258 | A | | 10/2010 |
| JP | 2018-127331 | A | | 8/2018 |
| JP | 2005-255403 | A | | 6/2024 |

OTHER PUBLICATIONS

Written Opinion dated Oct. 12, 2021 for corresponding PCT Application No. PCT/JP2021/034164 (3 pages) with English Translation (3 pages).
International Preliminary Report on Patentability dated Mar. 5, 2024 for corresponding PCT Application No. PCT/JP2021/034164 (4 pages) with English Translation (4 pages).

* cited by examiner

MEDIUM CONVEYING APPARATUS

CROSS-REFERENCE TO RELATED APPLICATION

This patent application is a continuation application of International Application No. PCT/JP2021/034164, having an international filing date of Sep. 16, 2021, the entire disclosure of which is hereby incorporated by reference herein.

BACKGROUND

Technical Field

Embodiments of the present disclosure relate to a medium conveying apparatus, and more specifically to a medium conveying apparatus including a placement tray.

Related Art

In a medium conveying apparatus such as a scanner that captures an image while conveying a medium, a placement tray on which media are placed may be detachable from a housing in order to allow the medium conveying apparatus to be stored compactly on a shelf, or the like, while not in use.

There has been proposed a document feed table formed of a plate material that includes a document holding portion that holds a document and an insertion portion that is inserted into an engagement member provided on a device main body to engage the document holding portion with the device main body. In this document feed table, a cutout portion is provided between the document holding portion and the insertion portion to make the insertion portion flexible.

There has been proposed a medium feed device including a medium placement portion that is attachable to or detachable from a device main body and includes a placement surface for placing the media to be fed and a pair of edge guides provided on the medium placement portion and including guide surfaces for guiding the side edges in the width direction. In this medium feed device, the edge guide includes a protruding portion where at least part of the guide surface protrudes downstream in the feeding direction with respect to the medium placement portion.

SUMMARY

According to an embodiment of the present disclosure, a medium conveying apparatus includes a housing, a placement tray, and a side guide. The housing has an engaged portion and a guide surface for media. The placement tray is attachable to and detachable from the housing, and has an engaging portion engageable with the engaged portion and a placement surface for media. The placement tray forms a first angle with the guide surface when fixed to the housing. The side guide is mounted on the placement surface and protrudes downstream beyond the placement tray in a medium conveying direction to restrict a medium in a width direction perpendicular to the medium conveying direction. The engaged portion is configured to restrict entry or removal of the engaging portion when the placement surface forms the first angle with the guide surface in attachment of the placement tray to the housing or detachment of the placement tray from the housing, and allow entry or removal of the engaging portion when the placement surface forms a second angle different from the first angle with the guide surface in attachment of the placement tray to the housing or detachment of the placement tray from the housing. A downstream end of the side guide in the medium conveying direction does not intersect with the guide surface as viewed from the width direction when the placement surface forms the second angle with the guide surface in attachment of the placement tray to the housing or detachment of the placement tray from the housing.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
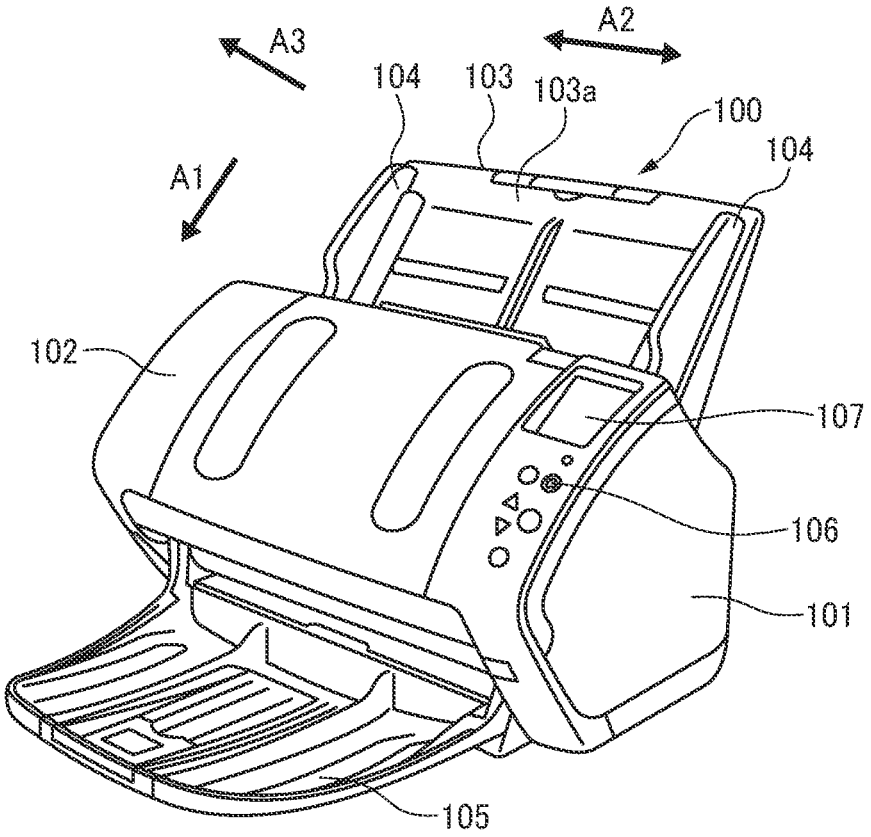
FIG. 1 is a perspective view of a medium conveying apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A medium conveying apparatus, a control method, and a non-transitory recording medium according to an aspect of the present disclosure will be described below with reference to the drawings. It is noted that the technical scope of the present embodiment is not limited to the embodiments thereof, but also includes the invention set forth in the scope of claims and its equivalents.

FIG. 1 is a perspective view of a medium conveying apparatus 100 configured as an image scanner. The medium conveying apparatus 100 conveys a medium, which is a document, and captures an image. The medium may be a sheet of paper, a thin sheet of paper, a cardboard, a card, a copier paper sheet, an envelope, etc. The medium conveying apparatus 100 may be a facsimile machine, a copier, a printer multifunction peripheral (MFP), etc. The medium to be conveyed may be an object to be printed, etc., instead of a document, and the medium conveying apparatus 100 may be a printer or the like. In FIG. 1, arrow A1 indicates a medium conveying direction, arrow A2 indicates a width direction perpendicular to the medium conveying direction, and arrow A3 indicates a height direction perpendicular to the medium conveying direction A1 and the width direction A2. In the following description, the term "upstream" refers to the upstream in the medium conveying direction A1, and the term "downstream" refers to the downstream in the medium conveying direction A1.

The medium conveying apparatus 100 includes a lower housing 101, an upper housing 102, a placement tray 103, side guides 104, a discharge tray 105, an operating device 106, and a display device 107.

The lower housing 101 is an example of a housing. The lower housing 101 and the upper housing 102 include a resin material such as polystyrene (PS) or acrylonitrile butadiene styrene (ABS). The upper housing 102 is positioned to cover an upper surface of the medium conveying apparatus 100 and is engaged with the lower housing 101 with a hinge so as to be opened and closed when a medium is jammed, when the inside of the medium conveying apparatus 100 is cleaned, etc.

The placement tray 103 is engaged with the lower housing 101 such that the placement tray 103 is inclined with respect to the horizontal direction. The placement tray 103 may be arranged substantially parallel with respect to the horizontal direction. The placement tray 103 includes a resin material such as PS or ABS. The placement tray 103 includes a placement surface 103*a* for media, on which the media to be fed and conveyed are placed. The placement tray 103 is attachable to or detachable from the lower housing 101. The side guides 104 are mounted on the placement surface 103*a* of the placement tray 103 to be movable in the width direction A2 perpendicular to the medium conveying direction. The side guides 104 are positioned to match the width of the medium placed on the placement tray 103 and restricts the medium in the width direction. In the example illustrated in FIG. 1, the two side guides 104 are spaced side by side in the width direction A2. The number of the side guides 104 may be one.

The discharge tray 105 is engaged with the upper housing 102 to place the discharged media. The discharge tray 105 may be engaged with the lower housing 101.

The operating device 106 includes an input device such as a button and an interface circuit that acquires signals from the input device, accepts user's input operations, and outputs operation signals corresponding to user's input operations. The display device 107 includes a display including a liquid crystal display, an organic electro-luminescence (EL) display, etc., and an interface circuit that outputs image data to the display, and displays image data on the display.

Figure 2B:
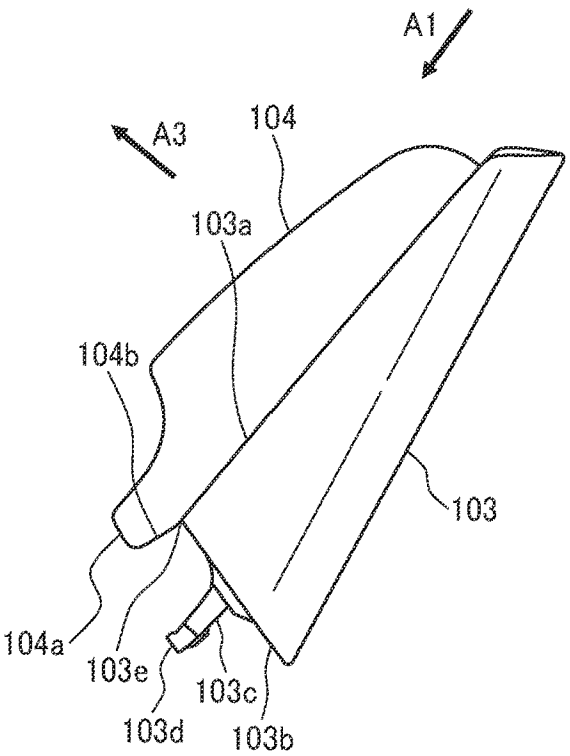
FIGS. 2A and 2B are schematic views of a placement tray according to an embodiment of the present disclosure.
Figure 2A:
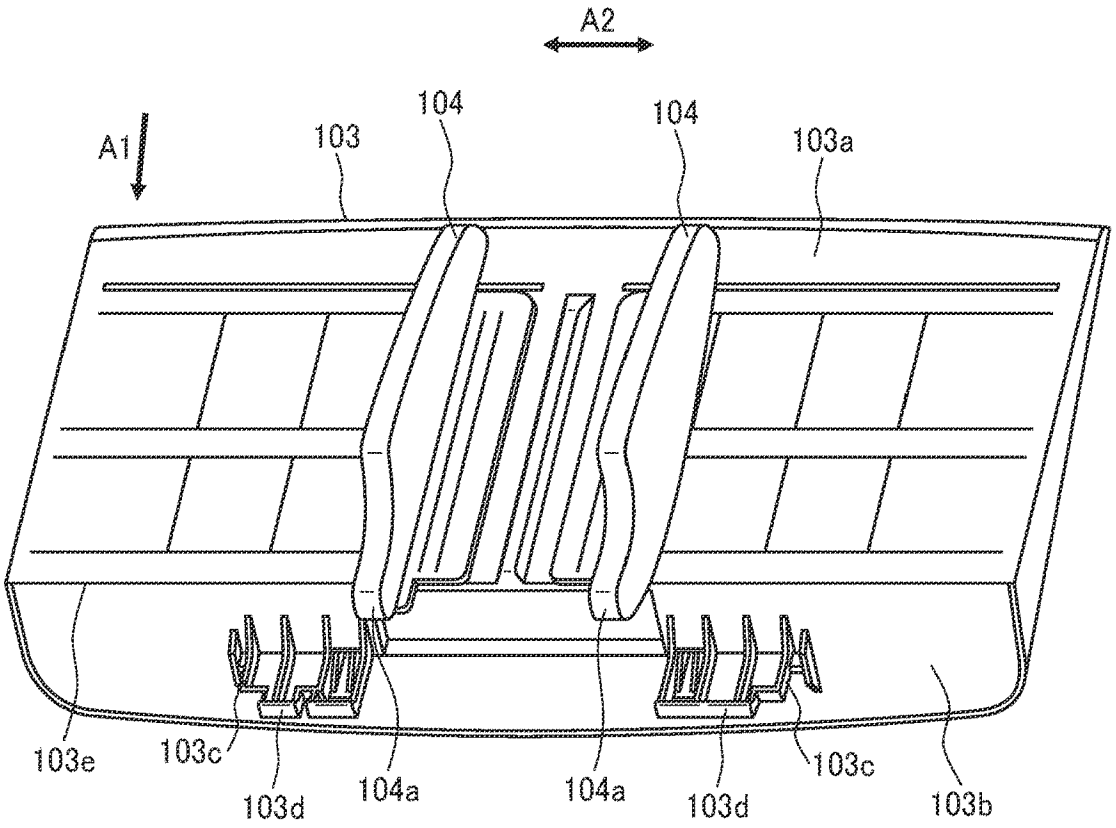

FIGS. 2A and 2B are schematic views illustrating the placement tray 103. FIG. 2A is a perspective view of the placement tray 103 detached from the lower housing 101 when viewed from above, and FIG. 2B is a side view of the placement tray 103 detached from the lower housing 101 when viewed from the lateral side.

As illustrated in FIGS. 2A and 2B, a downstream surface 103*b* of the placement tray 103 opposed to the lower housing 101 includes an engaging portion 103*c* that is engageable with an engaged portion, which is described below, of the lower housing 101. In the example illustrated in FIG. 2A, the two engaging portions 103*c* are spaced side by side in the width direction A2. The number of the engaging portions 103*c* may be one or may be three or more.

The side guide 104 is provided to protrude downstream beyond the placement tray 103 in the medium conveying direction A1. As the side guide 104 protrudes downstream, the medium conveying apparatus 100 may prevent tilt of the medium being conveyed and may prevent the occurrence of skew of the medium. A downstream end 103*d* of the engaging portion 103*c* is located further downstream than a downstream end 104*a* of the side guide 104. In particular, the engaging portion 103*c* is provided such that the length by which the engaging portion 103*c* protrudes downstream beyond a downstream end 103*e* of the placement surface 103*a* is longer than the length by which the downstream end 104*a* of the side guide 104 protrudes downstream beyond the downstream end 103*e* of the placement surface 103*a*. The engaging portion 103*c* is formed such that the downstream end 103*d* of the engaging portion 103*c* is located at a position sufficiently away from the downstream end 103*e* of the placement surface 103*a* (e.g., a position away by 5 mm or more, more preferably 15 mm or more). The downstream end 103*d* of the engaging portion 103*c* is formed to protrude upward, i.e., toward the placement surface 103*a*.

A lower surface 104*b* of a protruding portion of the side guide 104 is inclined with respect to an extended surface of the placement surface 103*a* of the placement tray 103. The lower surface 104*b* of the protruding portion of the side guide 104 is provided to be located higher, i.e., the further downstream position is the further away from the extended surface of the placement surface 103*a*. The angle formed between the lower surface 104*b* of the protruding portion of the side guide 104 and the placement surface 103*a* is set to, for example, an angle more than 0° and 30° or less.

Figure 3A:
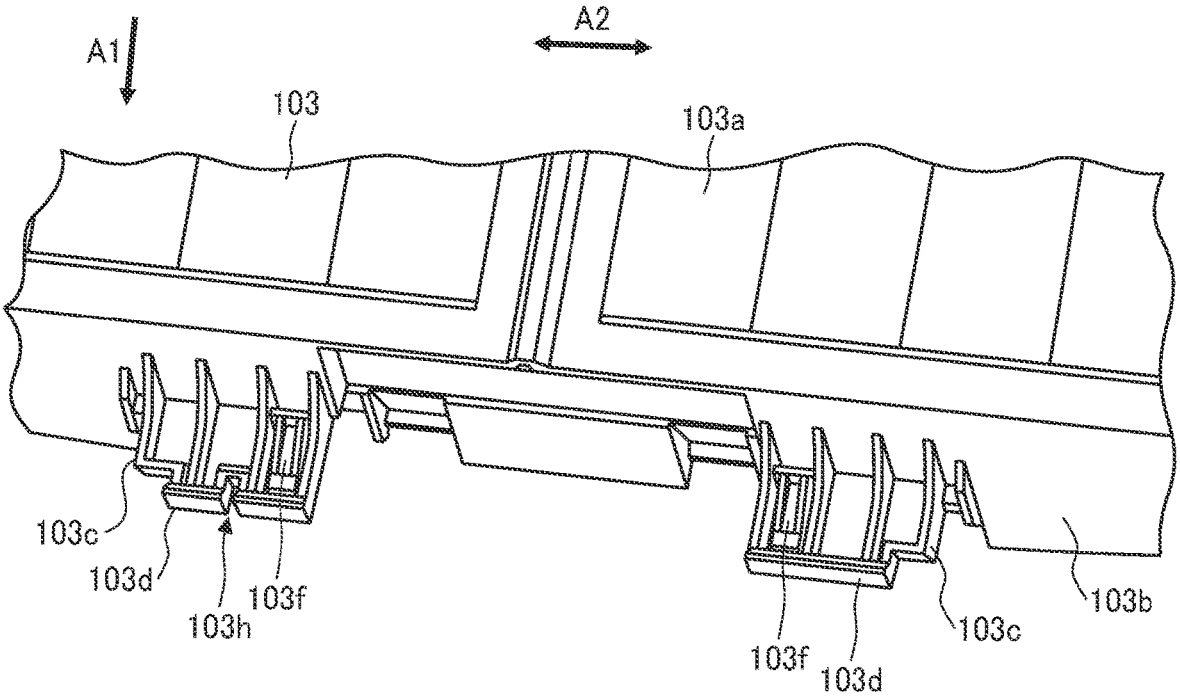
FIGS. 3A and 3B are schematic views of an engaging portion according to an embodiment of the present disclosure.
Figure 3B:
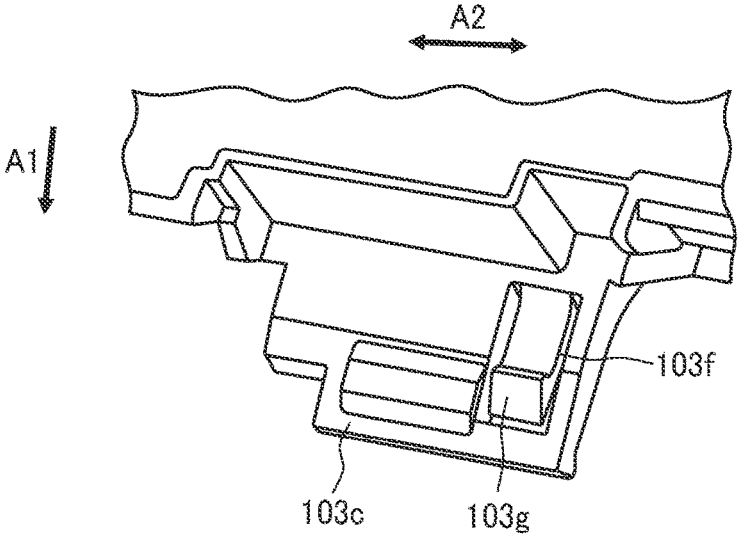

FIGS. 3A and 3B are schematic views of the engaging portion 103*c*. FIG. 3A is an enlarged view of an area around the engaging portion 103*c* in FIG. 2A, and FIG. 3B is a perspective view of the engaging portion 103*c* when viewed from below.

As illustrated in FIGS. 3A and 3B, an elastic claw portion 103*f* is provided inside the engaging portion 103*c*. The claw portion 103*f* has an upstream end disposed on a downstream surface of the placement tray 103 and is swingable with the upstream end as a swing axis. As illustrated in FIG. 3B, a lower surface 103*g* of the claw portion 103*f* is formed to protrude downward, i.e., toward the opposite side of the placement surface 103*a*. The engaging portion 103*c* and the claw portion 103*f* are formed integrally with the downstream surface of the placement tray 103 with a flexible material. The claw portion 103*f* swings upward when the lower surface 103*g* is pressed upward (toward the placement surface 103*a*).

The downstream end 103*d* of the engaging portion 103*c* includes a recessed portion 103*h* that is engageable with a projection portion, described below, provided in the lower housing 101.

Figure 4:
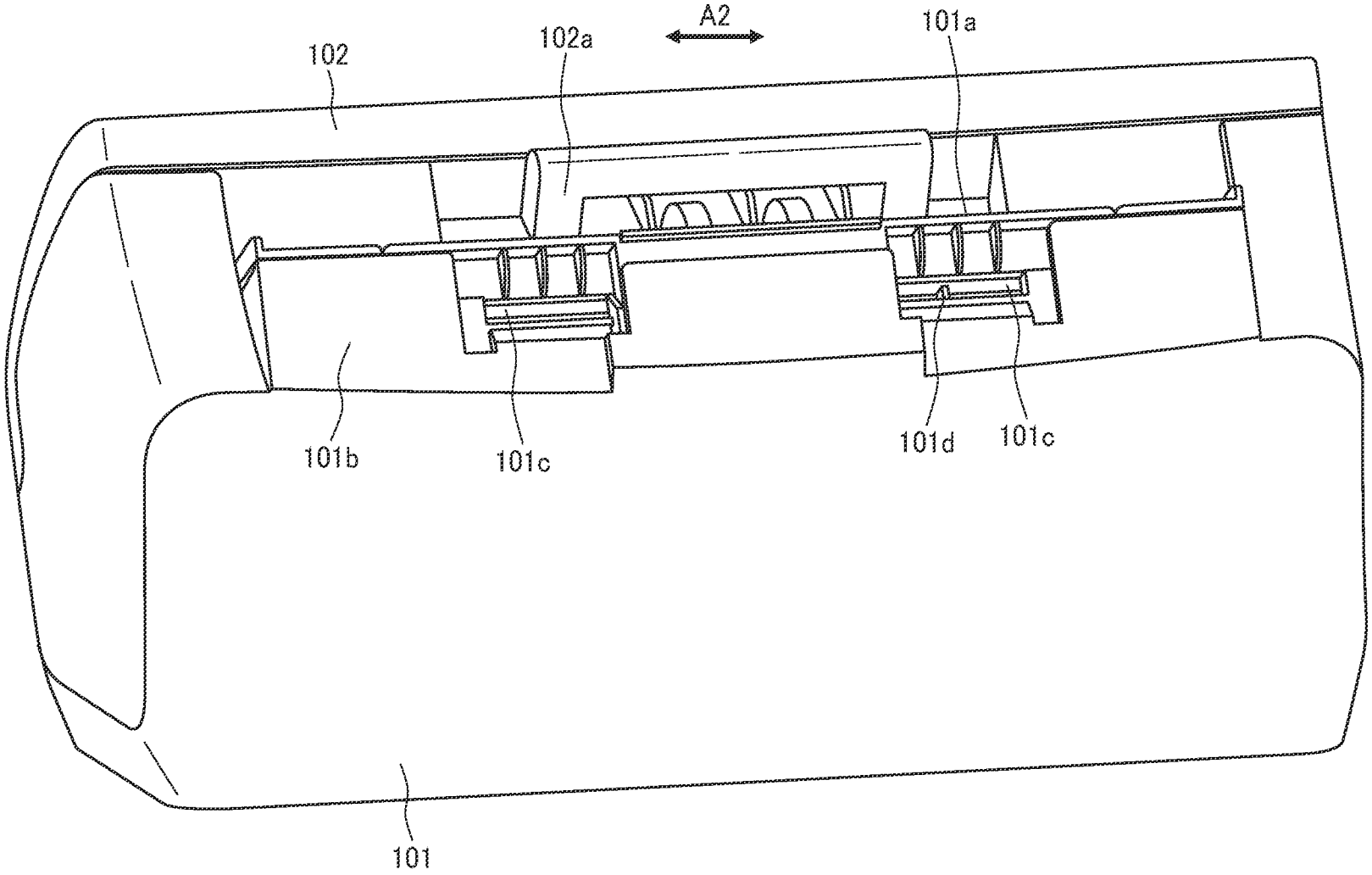
FIG. 4 is a schematic view of a lower housing according to an embodiment of the present disclosure.

FIG. 4 is a schematic view of the lower housing 101 and the upper housing 102. FIG. 4 is a perspective view of the lower housing 101 and the upper housing 102 with the placement tray 103 detached when viewed from the upstream side.

As illustrated in FIG. 4, the lower housing 101 and the upper housing 102 include a lower guide surface 101*a* and an upper guide surface 102*a*, respectively, to guide the conveyed medium. The lower guide surface 101*a* is an example of a guide surface for media.

An upstream surface 101*b* of the lower housing 101 opposed to the placement tray 103 includes an engaged portion 101*c* that is engageable with the engaging portion 103*c* included in the placement tray 103. The number of the engaged portions 101*c* is the same as the number of the engaging portions, and in the example illustrated in FIG. 4, the two engaged portions 101*c*, which are engaged with the two engaging portions 103*c*, are spaced side by side in the width direction A2.

The engaged portion 101*c* includes a projection portion 101*d* that is engageable with the recessed portion 103*h* included in the engaging portion 103*c*. By engaging the projection portion 101*d* with the recessed portion 103*h*, the placement tray 103 is positioned with respect to the lower housing 101 in the width direction A2 perpendicular to the medium conveying direction. In the medium conveying apparatus 100, it is possible to simplify the structure of the apparatus since the placement tray 103 can be positioned by using the engaging portion 103*c* and the engaged portion 101*c* for engaging the placement tray 103 to the lower housing 101 without using a special positioning member for positioning. The engaging portion 103*c* may include a projection portion, and the engaged portion 101*c* may include a recessed portion. In such a case, the projection portion included in the engaging portion 103*c* is engaged with the recessed portion included in the engaged portion 101*c* such that the placement tray 103 is positioned with respect to the lower housing 101 in the width direction A2 perpendicular to the medium conveying direction A1.

FIGS. 5 to 9 are schematic views illustrating the relationship between the engaging portion 103*c* and the engaged portion 101*c*. FIGS. 5 to 9 are cross-sectional views of an area around the engaging portion 103*c* and the engaged portion 101*c* when viewed from the side.

Figure 5:
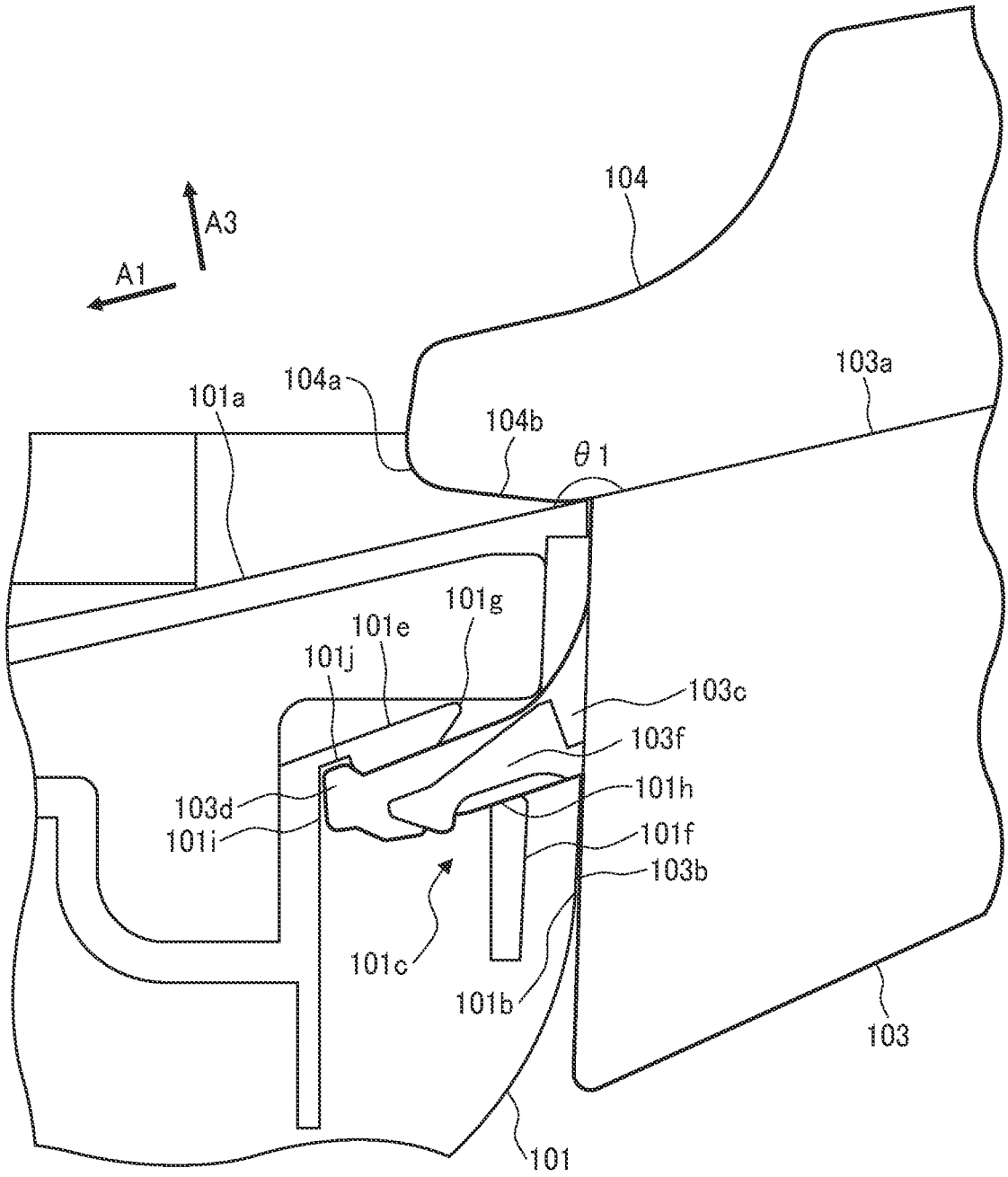
FIG. 5 is a schematic view of the engaging portion and an engaged portion according to an embodiment of the present disclosure.

FIG. 5 illustrates a state where the placement tray 103 is attached and fixed to the lower housing 101. In the following description, the position where the placement tray 103 is fixed to the lower housing 101 to place the medium, as illustrated in FIG. 5, may be referred to as a fixed position.

As illustrated in FIG. 5, the engaged portion 101*c* of the lower housing 101 includes a first engaged portion 101*e* and a second engaged portion 101*f*. The first engaged portion 101*e* is provided above the engaging portion 103*c*, which is located in the engaged portion 101*c*, to extend substantially parallel to the extending direction of the engaging portion 103*c*. A downstream end of the first engaged portion 101*e* includes a wall portion 101*i* and a recessed portion 101*j*. The second engaged portion 101*f* is provided below the engaging portion 103*c*, which is located in the engaged portion 101*c*, to extend substantially parallel to the height direction A3. The first engaged portion 101*e* and the second engaged portion 101*f* form an entrance for the engaging portion 103*c* into the engaged portion 101*c*. An upstream end big of the first engaged portion 101*e* is positioned downstream of and above an upper end 101*h* of the second engaged portion 101*f*, and therefore the entrance is formed to open upstream and upward.

When the downstream end 103*d* of the engaging portion 103*c* abuts the wall portion 101*i* provided within the engaged portion 101*c* and is fitted into the recessed portion 101*j*, an upper surface of the engaging portion 103*c* is in contact with the first engaged portion 101*e* and a lower surface of the engaging portion 103*c* is in contact with the second engaged portion 101*f*. Accordingly, the engaging portion 103*c* is engaged with the engaged portion 101*c*. When the engaging portion 103*c* is engaged with the engaged portion 101*c*, the downstream surface 103*b* of the placement tray 103 is in contact with the upstream surface 101*b* of the lower housing 101. Accordingly, the placement tray 103 is supported by and fixed to the lower housing 101.

The placement surface 103*a* of the placement tray 103 is positioned to form a first angle θ1 with the lower guide surface 101*a* of the lower housing 101 when the placement tray 103 is located in the fixed position and is fixed to the lower housing 101. The first angle θ1 is for example 180°. That is, the placement surface 103*a* and the lower guide surface 101*a* are provided to be flush when the placement tray 103 is fixed to the lower housing 101. This allows the medium conveying apparatus 100 to smoothly convey a medium along the placement surface 103*a* and the lower guide surface 101*a* and enhance the conveyance of media.

The first angle θ1 is not limited to 180°, but is set to an angle within the range where the media can be conveyed (e.g., the range of 150° or more and 180° or less).

In a state where the placement tray 103 is located in the fixed position, the lower surface 104*b* of the protruding portion of the side guide 104 is inclined with respect to the lower guide surface 101*a* of the lower housing 101. The lower surface 104*b* of the protruding portion of the side guide 104 is located higher, i.e., the further downstream position is the further away from the lower guide surface 101*a*. The angle formed between the lower surface 104*b* of the protruding portion of the side guide 104 and the lower guide surface 101*a* is set to, for example, an angle more than 0° and 30° or less.

Figure 6:
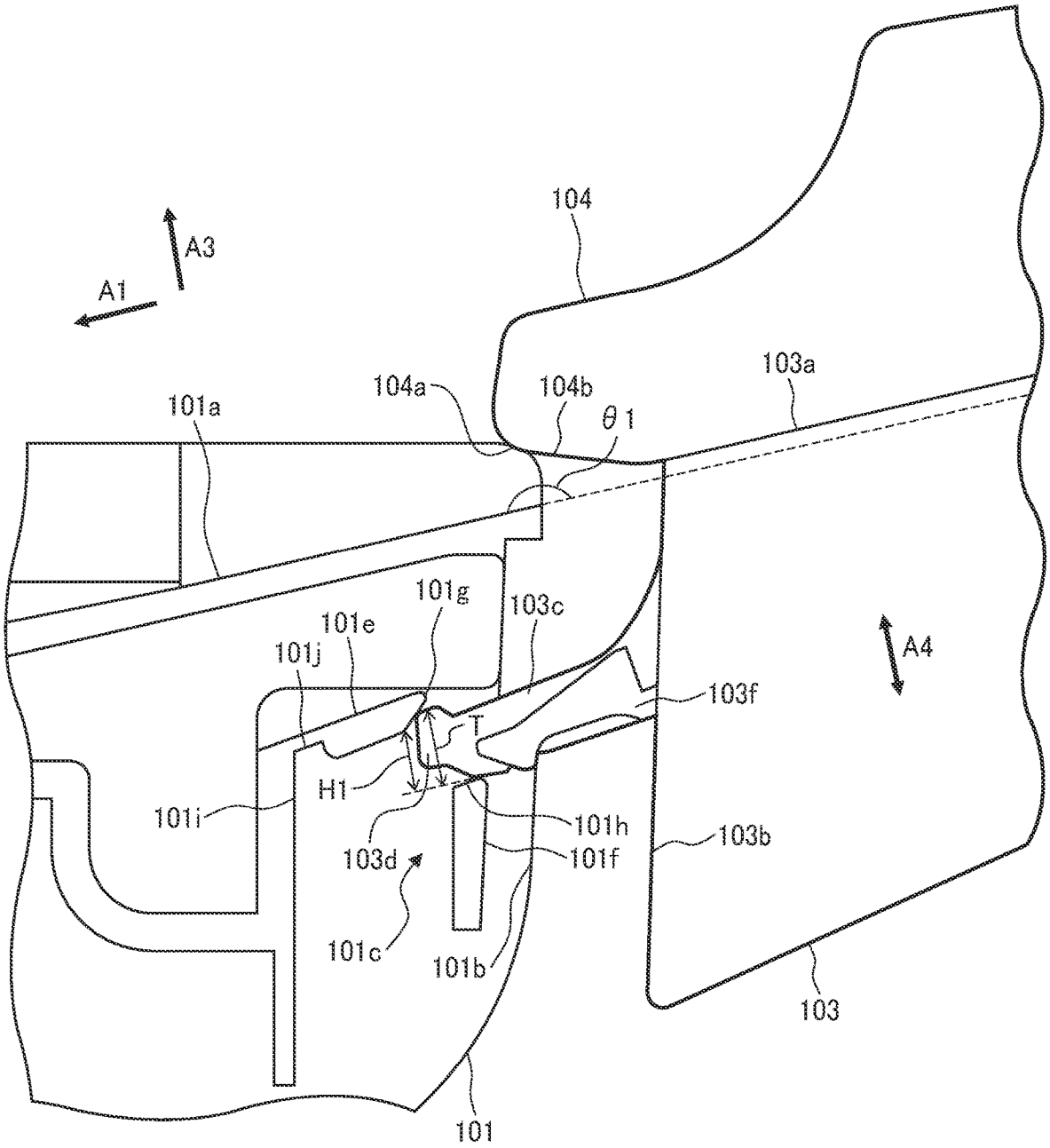
FIG. 6 is a schematic view of the engaging portion and the engaged portion illustrated in FIG. 5.

FIG. 6 illustrates a state in the process of attaching the placement tray 103 to the lower housing 101. In the state illustrated in FIG. 6, the placement surface 103*a* and the lower guide surface 101*a* are positioned such that the placement surface 103*a* and the lower guide surface 101*a* form the first angle θ1 when the placement tray 103 is fixed to the lower housing 101.

As illustrated in FIG. 6, when the placement surface 103*a* and the lower guide surface 101*a* form the first angle θ1, a size H1 of the entrance into the engaged portion 101*c* of the lower housing 101 in a thickness direction A4 perpendicular to the extending direction of the engaging portion 103*c* is smaller than a thickness T of the engaging portion 103*c*. Therefore, the engaging portion 103*c* gets caught at the entrance into the engaged portion 101*c* and is prevented from entering the engaged portion 101*c*. As described above, the engaged portion 101*c* restricts entry of the engaging portion 103*c* when the placement surface 103*a* forms the first angle θ1 with the lower guide surface 101*a*, i.e., at the same inclination as that at the fixed position, in attachment of the placement tray 103 to the lower housing 101.

Figure 7:
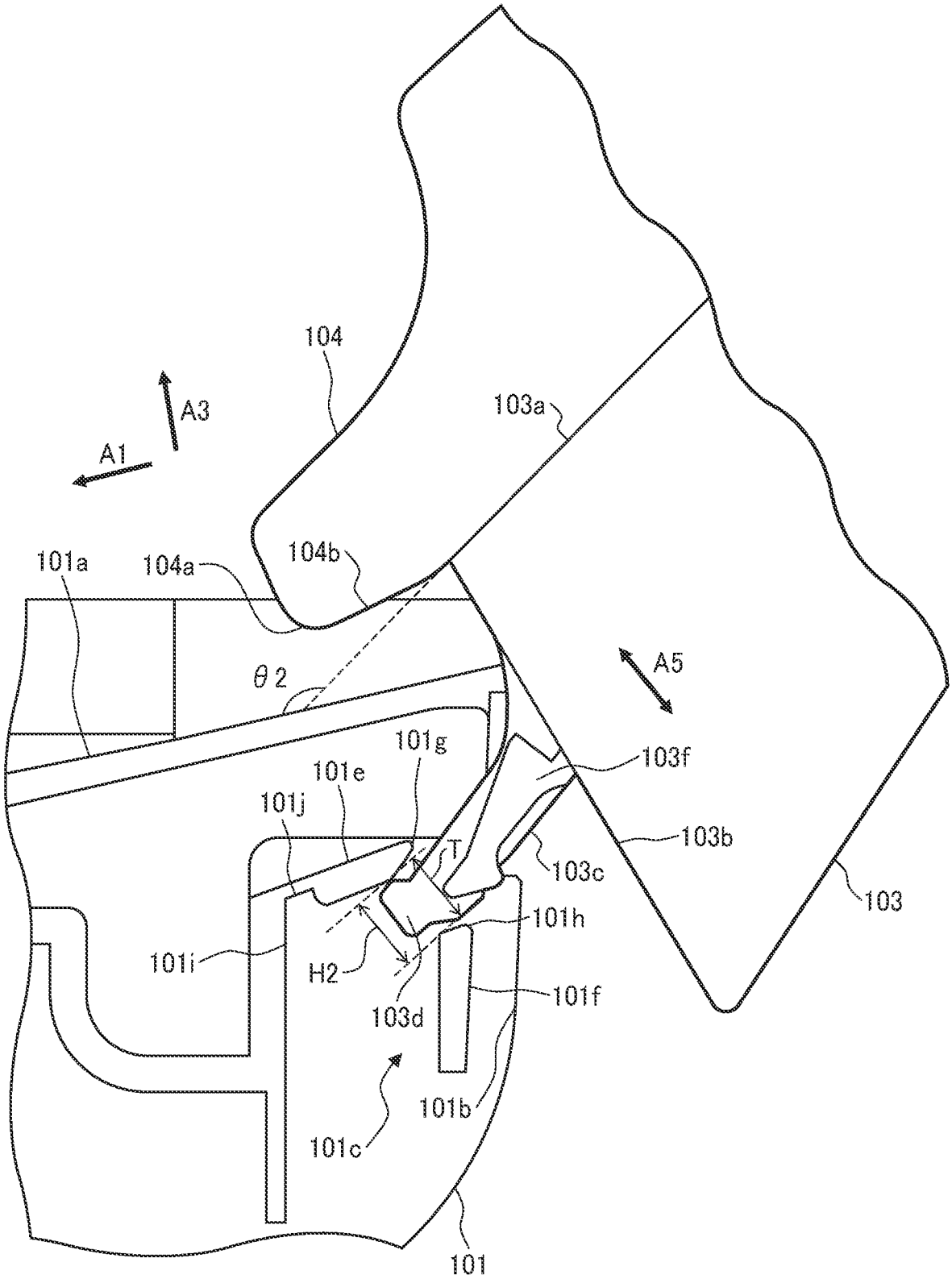
FIG. 7 is a schematic view of the engaging portion and the engaged portion illustrated in FIG. 5.

FIG. 7 illustrates a state in the process of attaching the placement tray 103 to the lower housing 101, as in FIG. 6. However, in the state illustrated in FIG. 7, the placement tray 103 is inclined with respect to the fixed position. That is, the placement surface 103*a* and the lower guide surface 101*a* are positioned such that the placement surface 103*a* and the lower guide surface 101*a* form a second angle θ2 different from the first angle θ1, which is formed by the placement surface 103*a* and the lower guide surface 101*a* when the placement tray 103 is fixed to the lower housing 101. In particular, the second angle θ2 is smaller than the first angle θ1 and is set, for example in the range from 120° to 150°.

As described above, the upstream end big of the first engaged portion 101*e* is positioned downstream of and above the upper end 101*h* of the second engaged portion 101*f*, that is, in an oblique direction with respect to the height direction A3. Therefore, the Euclidean distance between the upstream end big of the first engaged portion 101*e* and the upper end 101*h* of the second engaged portion 101*f* is sufficiently larger than the distance in the height direction A3. In particular, as illustrated in FIG. 7, when the placement surface 103*a* and the lower guide surface 101*a* form the second angle θ2, a size H2 of the entrance into the engaged portion 101*c* of the lower housing 101 in a thickness direction A5 perpendicular to the extending direction of the engaging portion 103*c* is equal to or more than the thickness T of the engaging portion 103*c*. Therefore, the engaging portion 103*c* can pass through the entrance into the engaged portion 101*c* and enter the engaged portion 101*c*.

Figure 8:
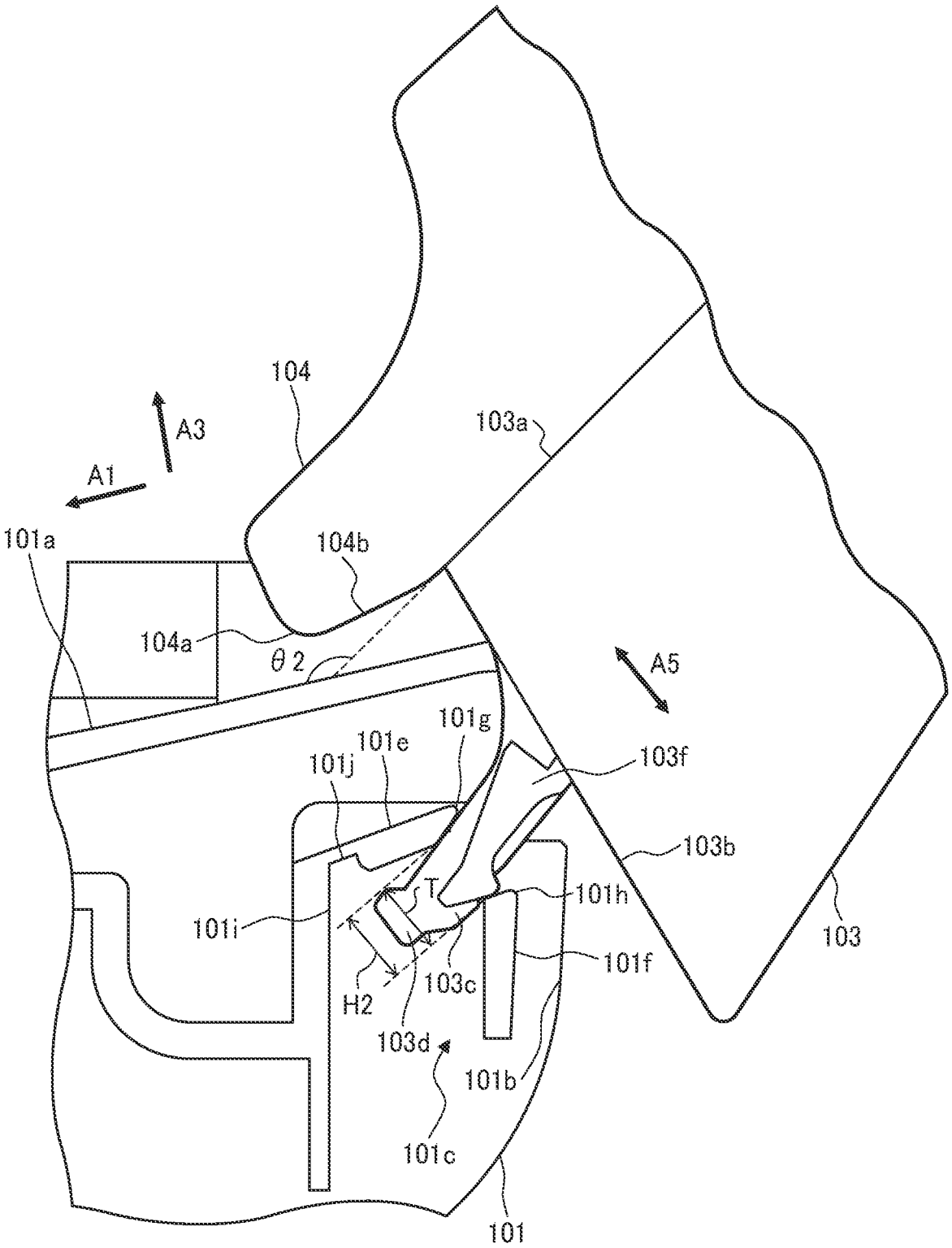
FIG. 8 is a schematic view of the engaging portion and the engaged portion illustrated in FIG. 5.

FIG. 8 illustrates a state where the engaging portion 103*c* has entered the engaged portion 101*c* from the state illustrated in FIG. 7. In the following description, the position in which the placement tray 103 is inclined with respect to the fixed position for attachment to the lower housing 101, as illustrated in FIGS. 7 and 8, may be referred to as the inclined position.

As illustrated in FIG. 8, when the placement surface 103*a* forms the second angle θ2 with the lower guide surface 101*a*, the engaging portion 103*c* passes through the entrance into the engaged portion 101*c* and enters the engaged portion 101*c*. As described above, the engaged portion 101*c* allows entry of the engaging portion 103*c* when the placement surface 103*a* forms the second angle θ2 different from the first angle θ1 with the lower guide surface 101*a*, i.e., the placement surface 103*a* is positioned in the inclined position, in attachment of the placement tray 103 to the lower housing 101.

That is, the entrance into the engaged portion 101*c* of the lower housing 101 has a shape that allows entry of the engaging portion 103*c* when the placement surface 103*a* and the lower guide surface 101*a* form the second angle θ2. Conversely, as illustrated in FIG. 6, the entrance into the engaged portion 101*c* of the lower housing 101 has a shape that prevents entry of the engaging portion 103*c* when the placement surface 103*a* and the lower guide surface 101*a* form an angle (including the first angle θ1) outside a predetermined range with respect to the second angle θ2. This makes it possible for the medium conveying apparatus 100 to allow or restrict entry of the engaging portion 103*c* into the engaged portion 101*c* with a simple structure, and it is possible to set the placement tray 103 in a desirable manner while suppressing an increase in design and manufacturing man-hours for the medium conveying apparatus 100.

Figure 9:
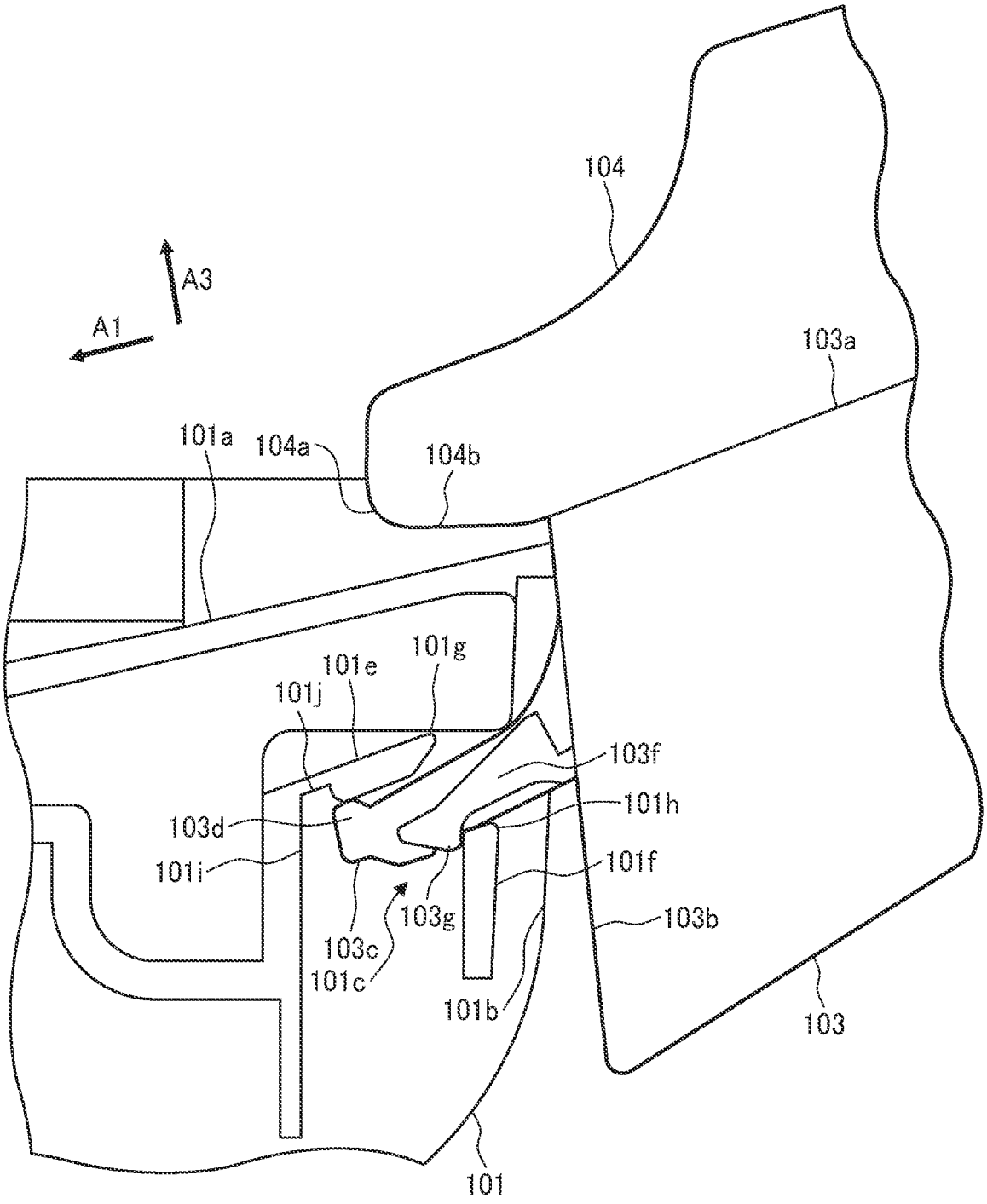
FIG. 9 is a schematic view of the engaging portion and the engaged portion illustrated in FIG. 5.

FIG. 9 illustrates a state where the engaging portion 103*c* has further entered the engaged portion 101*c* from the state illustrated in FIG. 8.

As illustrated in FIG. 9, the placement tray 103 is moved downstream while the placement tray 103 is tilt down such that the angle formed between the placement surface 103*a* and the lower guide surface 101*a* becomes closer to the first angle θ1 from the second angle θ2. This causes the engaging portion 103*c* to further enter the engaged portion 101*c*. As described above, the lower surface 103*g* of the claw portion 103*f* is swingable upward and is formed to protrude downward. The lower surface 103*g* is pushed upward by the upper end 101*h* of the second engaged portion 101*f* while passing through the second engaged portion 101*f* and then returns to its original position to engage with the second engaged portion 101*f* after passing through the second engaged portion 101*f*.

When the engaging portion 103*c* of the placement tray 103 enters the engaged portion 101*c* of the lower housing 101, the user may feel that the engaging portion 103*c* has engaged with the engaged portion 101*c* by the vibration that occurs when the engaging portion 103*c* of the placement tray 103 enters the engaged portion 101*c* of the lower housing 101 and the claw portion 103*f* engages with the second engaged portion 101*f*. This allows the medium conveying apparatus 100 to prevent the user from terminating the insertion operation of the placement tray 103 while the placement tray 103 is not completely inserted into the lower housing 101 and thus prevent the occurrence of damages to the placement tray 103 due to falling, etc.

From the state illustrated in FIG. 9, the placement tray 103 is moved downstream until the downstream end 103*d* of the engaging portion 103*c* abuts the wall portion 101*i* and is then tilt down such that the angle formed between the placement surface 103*a* and the lower guide surface 101*a* further becomes closer to the first angle θ1. Accordingly, as illustrated in FIG. 5, the downstream end 103*d* of the engaging portion 103*c* is fitted into the recessed portion 101*j* provided within the engaged portion 101*c*, and the engaging portion 103*c* is engaged with the engaged portion 101*c*. As the downstream end 103*d* is fitted into the recessed portion 101*j*, the removal of the placement tray 103 from the lower housing 101 is prevented even when a force is accidentally applied in a direction to remove the placement tray 103. The upper surface and the lower surface of the engaging portion 103*c* are in contact with the first engaged portion 101*e* and the second engaged portion 101*f*, respectively, and the downstream surface 103*b* of the placement tray 103 is in contact with the upstream surface 101*b* of the lower housing 101 so that the placement tray 103 is stably supported and fixed to the lower housing 101.

The second angle θ2 formed by the placement surface 103*a* and the lower guide surface 101*a* when the placement tray 103 is placed in the inclined position is set to be smaller than the first angle θ1 formed by the placement surface 103*a* and the lower guide surface 101*a* when the placement tray 103 is placed in the fixed position. Accordingly, when the placement tray 103 moves (swings) from the inclined position to the fixed position, the angle formed by the placement surface 103*a* and the lower guide surface 101*a* approaches horizontal, and the downstream surface 103*b* of the placement tray 103 approaches the upstream surface 101*b* of the lower housing 101. When the placement tray 103 is placed in the fixed position, the downstream surface 103*b* of the placement tray 103 is in contact with the upstream surface 101*b* of the lower housing 101, and the placement tray 103 is stably supported by the lower housing 101.

The operation of detaching the placement tray 103 from the lower housing 101 is performed by the procedure opposite to the operation of attaching the placement tray 103 to the lower housing 101. Ina state where the placement tray 103 is attached to the lower housing 101 as illustrated in FIG. 5, the downstream end 103*d* of the engaging portion 103*c* is fitted into the recessed portion 101*j* so that the engaging portion 103*c* is not removed from the engaged portion 101*c*.

As illustrated in FIG. 6, when the placement surface 103*a* and the lower guide surface 101*a* form the first angle θ1, the size H1 of the entrance into the engaged portion 101*c* in the thickness direction A4 of the engaging portion 103*c* is smaller than the thickness T of the engaging portion 103*c*. Therefore, even when the downstream end 103*d* of the engaging portion 103*c* is not fitted into the recessed portion 101*j*, the engaging portion 103*c* is caught on the entrance into the engaged portion 101*c* and is not removed from the engaged portion 101*c*. Thus, the entrance into the engaged portion 101*c* of the lower housing 101 has a shape that prevents removal of the engaging portion 103*c* in a state where the placement surface 103*a* and the lower guide surface 101*a* form an angle (including the first angle θ1) outside the predetermined range with respect to the second angle θ2. Due to the shape of the entrance, the engaged portion 101*c* restricts removal of the engaging portion 103*c* when the placement surface 103*a* forms the first angle θ1 with the lower guide surface 101*a* in detachment of the placement tray 103 from the lower housing 101.

The placement tray 103 is inclined from the state where the placement tray 103 is attached to the lower housing 101 such that the angle formed by the placement surface 103*a* and the lower guide surface 101*a* becomes closer to the second angle θ2 from the first angle θ1. Thus, as illustrated in FIG. 9, the contact between the downstream end 103*d* of the engaging portion 103*c* and the recessed portion 101*j* is released, and the engaging portion 103*c* is separated from the engaged portion 101*c*. From this state, as illustrated in FIG. 8, the placement tray 103 is inclined such that the angle formed by the placement surface 103*a* and the lower guide surface 101*a* becomes the second angle θ2, and the engaging portion 103*c* is pulled out of the engaged portion 101*c*, as illustrated in FIG. 7. Thus, the entrance into the engaged portion 101*c* of the lower housing 101 has a shape that allows removal of the engaging portion 103*c* when the placement surface 103*a* and the lower guide surface 101*a* form the second angle θ2. Due to the shape of the entrance, the engaged portion 101*c* allows removal of the engaging portion 103*c* when the placement surface 103*a* forms the second angle θ2 with the lower guide surface 101*a* in detachment of the placement tray 103 from the lower housing 101.

Thus, in the medium conveying apparatus 100, the placement tray 103 is attachable to or detachable from the lower housing 101 when the placement tray 103 is inclined with respect to the fixed position, which is the installation position while in use (during media conveyance). The user tilt down the placement tray 103 after entering the lower housing 101 with inclined with respect to the fixed position and thus may easily attach the placement tray 103 to the lower housing 101. Furthermore, the user inclines the placement tray 103 in the fixed position and thus may easily detach the placement tray 103 from the lower housing 101. Conversely, the placement tray 103 in the fixed position is not detached from the lower housing 101 unless the placement tray 103 is inclined. Therefore, the medium conveying apparatus 100 may prevent the placement tray 103 from accidentally falling down when the user accidentally hits his/her hand on the medium conveying apparatus 100, when the user carries the medium conveying apparatus 100, etc.

For example, the medium conveying apparatus may include any locking mechanism to fix the placement tray to the housing. However, in such a case, the user performs a locking operation to lock the placement tray to the housing after attaching the placement tray to the housing, which reduces the user convenience. In addition, when the user forgets to perform the locking operation, the placement tray may fall down from the housing and get damaged.

On the other hand, in the medium conveying apparatus 100, the user makes the placement tray 103 enter the lower housing 101 in an inclined state and then places the placement tray 103 in the fixed position so that the placement tray 103 is locked to the lower housing 101 at the same time the placement tray 103 is attached to the lower housing 101. The user locks the placement tray 103 to the lower housing 101 in a series of attachment actions and thus may easily perform the locking operation. Thus, the medium conveying apparatus 100 may improve the user convenience. It is unlikely that the user forgets to place the placement tray 103 in the fixed position while making the placement tray 103 enter the lower housing 101 in a series of attachment actions. Therefore, the medium conveying apparatus 100 may prevent the user from forgetting to perform the operation to lock the placement tray 103 and may prevent the occurrence of falling, such as falling of the placement tray 103.

In the medium conveying apparatus, the engaging portion on the placement tray side may be formed to be closely attached (press-fit) to the engaged portion on the housing side so that the detachable placement tray may be fixed to the housing. However, in such a case, in addition to the self-weight of the placement tray, the engaging portion and the engaged portion are subjected to the stress for joining the entire engaging portion and the entire engaged portion and supporting the placement tray. Accordingly, for example, when the user sets the medium on the placement tray, or when the user accidentally hits his/her hand on the placement tray, the engaging portion or the engaged portion is subjected to a large force, and the engaging portion or the engaged portion may get damaged. In addition, the user inserts the engaging portion on the placement tray side into the engaged portion on the housing side with a large force, and therefore the placement tray may fail to be inserted to the position where the placement tray is fixed to the housing. When the placement tray is not fixed, the medium may be lifted or skewed, which may result in media jams. Also, the user removes the engaging portion on the placement tray side from the engaged portion on the housing side with a large force.

Conversely, in the medium conveying apparatus 100, only the self-weight of the placement tray 103 is applied to the engaging portion 103*c* and the engaged portion 101*c*. Therefore, in the medium conveying apparatus 100, even when, for example, the user sets the medium on the placement tray 103, or when the user accidentally hits his/her hand on the placement tray 103, the force applied to the engaging portion

103*c* and the engaged portion 101*c* is sufficiently small, and the placement tray 103 is unlikely to get damaged. As described above, the user locks the placement tray 103 to the lower housing 101 in a series of attachment actions, and therefore the user is unlikely to forget to perform the operation to lock the placement tray 103. Therefore, the medium conveying apparatus 100 may prevent the occurrence of lifting or skewing of the medium as the placement tray 103 is used in an unfixed state, and as a result, the occurrence of media jams may be prevented. In the medium conveying apparatus 100, the engaging portion 103*c* on the placement tray 103 side and the engaged portion 101*c* on the lower housing 101 side are not formed to be closely attached to each other, and the user may insert and remove the placement tray 103 into and from the lower housing 101 with a little force.

As described above, the downstream end 103*d* of the engaging portion 103*c* of the placement tray 103 is provided to protrude further downstream than the downstream end 104*a* of the side guide 104 with respect to the downstream end 103*e* of the placement surface 103*a*. Specifically, the protrusion amount of the downstream end 104*a* of the side guide 104 is sufficiently smaller than the protrusion amount of the downstream end 103*d* of the engaging portion 103*c* of the placement tray 103. Furthermore, the engaging portion 103*c* is located at a position sufficiently away from the downstream end 103*e* of the placement surface 103*a*. The lower surface 104*b* of the protruding portion of the side guide 104 is provided such that the further downstream portion is the further away from the lower guide surface 101*a*.

Accordingly, as illustrated in FIGS. 5 and 7 to 9, the downstream end 104*a* of the side guide 104 does not come into contact with the lower guide surface 101*a* when the placement tray 103 is attached to or detached from the lower housing 101. Specifically, the downstream end 104*a* of the side guide 104 in the medium conveying direction A1 is provided so as not to intersect with the lower guide surface 101*a* when viewed from the width direction A2 perpendicular to the medium conveying direction in attachment of the placement tray 103 to the lower housing 101 or detachment of the placement tray 103 from the lower housing 101. In particular, as illustrated in FIG. 8, the downstream end 104*a* of the side guide 104 in the medium conveying direction is provided so as not to intersect with the lower guide surface 101*a* when viewed from the width direction A2 perpendicular to the medium conveying direction when the placement surface 103*a* forms the second angle θ2 with the lower guide surface 101*a*.

Therefore, in the medium conveying apparatus 100, there is no need to form a hole on the lower guide surface 101*a* for avoiding contact with the downstream end 104*a* of the side guide 104 and the lower guide surface 101*a* when attaching the placement tray 103 to the lower housing 101. Therefore, in the medium conveying apparatus 100, the lower guide surface 101*a* may be formed to be flat, and the medium may be guided in a desirable manner along the flat lower guide surface 101*a*.

Figure 10:
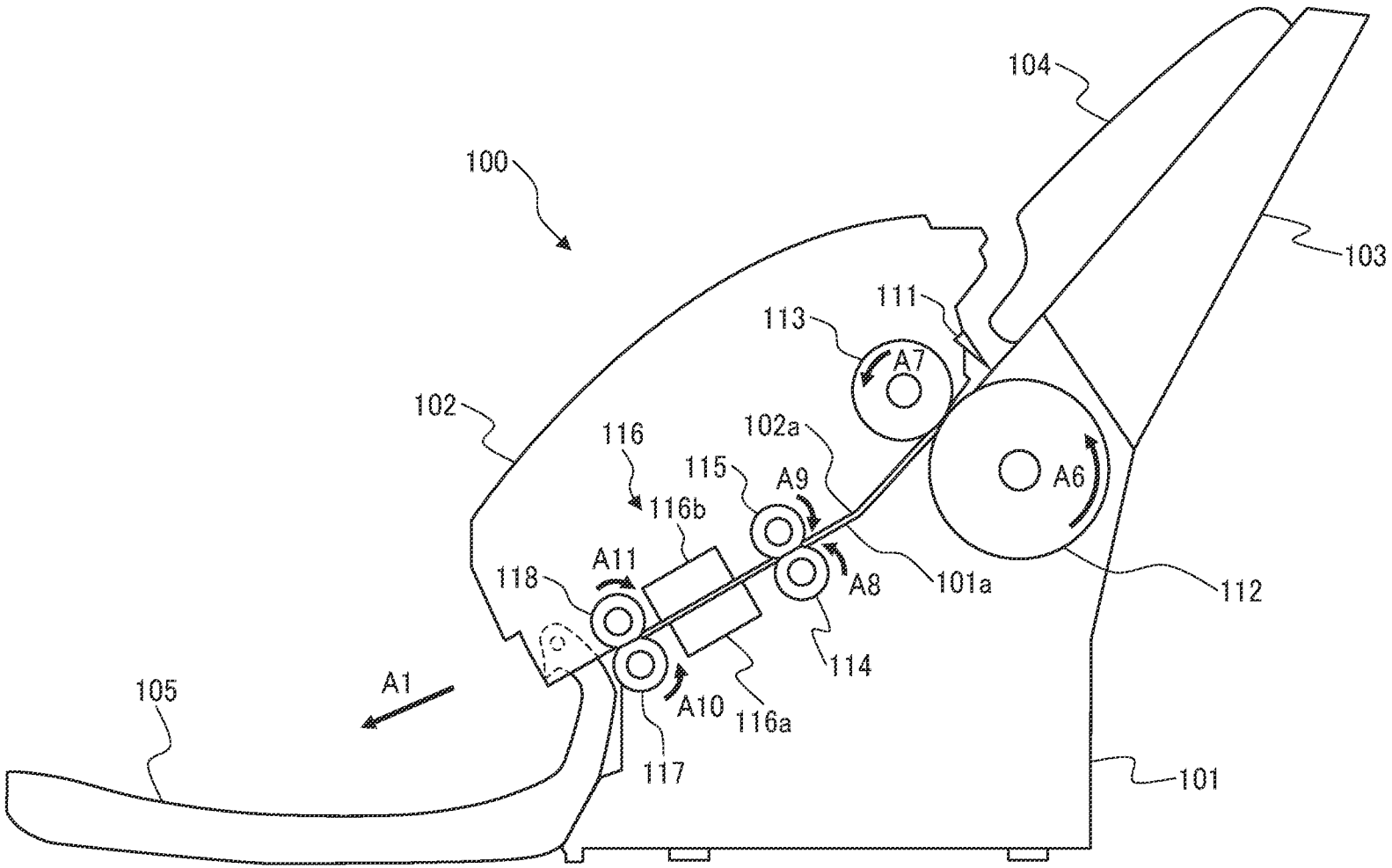
FIG. 10 is a schematic view of a conveyance path inside the medium conveying apparatus illustrated in FIG. 1.

FIG. 10 illustrates a conveyance path inside the medium conveying apparatus 100.

The conveyance path inside the medium conveying apparatus 100 includes a medium sensor 111, a feed roller 112, a separation roller 113, a first conveyance roller 114, a second conveyance roller 115, an imaging device 116, a first discharge roller 117, a second discharge roller 118, etc.

The number of the feed rollers 112, the separation rollers 113, the first conveyance rollers 114, the second conveyance rollers 115, the first discharge rollers 117, and/or the second discharge rollers 118 is not limited to one, but may be multiple. In that case, the feed rollers 112, the separation rollers 113, the first conveyance rollers 114, the second conveyance rollers 115, the first discharge rollers 117, and/or the second discharge rollers 118 are each spaced side by side in the width direction A2.

The upper surface of the lower housing 101 forms the lower guide surface 101*a* of the conveyance path for media, and the lower surface of the upper housing 102 forms the upper guide surface 102*a* of the conveyance path for media.

The medium sensor 111 is located upstream of the feed roller 112 and the separation roller 113. The medium sensor 111 includes a contact detection sensor to detect whether a medium is placed on the placement tray 103. The medium sensor 111 generates and outputs a medium signal whose signal value changes between a state where a medium is placed on the placement tray 103 and a state where no medium is placed. The medium sensor 111 is not limited to a contact detection sensor, and any other sensor that may detect the presence or absence of a medium, such as an optical detection sensor, may be used as the medium sensor 111.

The feed roller 112 is provided in the lower housing 101 to sequentially separate and feed the media placed on the placement tray 103, starting from the medium on the bottom. The separation roller 113 is what is called a brake roller or retard roller, and is provided in the upper housing 102, opposed to the feed roller 112, and rotates in the direction opposite to the medium feeding direction.

The first conveyance roller 114 and the second conveyance roller 115 are located downstream of the feed roller 112, opposed to each other, and convey the medium fed by the feed roller 112 and the separation roller 113 to the imaging device 116.

The imaging device 116 is located downstream of the first conveyance roller 114 and captures images of the medium conveyed by the first conveyance roller 114. The imaging device 116 includes a first imaging device 116*a* and a second imaging device 116*b* opposed to each other with the medium conveyance path interposed therebetween. The first imaging device 116*a* includes a line sensor using a contact image sensor (CIS) of same-magnification optics type including a complementary metal-oxide semiconductor (CMOS) imaging device arranged linearly in the main scanning direction. The first imaging device 116*a* includes a lens that forms an image on the imaging device and an analog-to-digital (A/D) converter that amplifies an electrical signal output from the imaging device and conducts A/D conversion. The first imaging device 116*a* generates and outputs an input image by capturing the front surface of the conveyed medium under the control of processing circuitry described below.

Similarly, the second imaging device 116*b* includes a line sensor using a CIS of same-magnification optics type including a CMOS imaging device arranged linearly in the main scanning direction. The second imaging device 116*b* includes a lens that forms an image on the imaging device and an A/D converter that amplifies an electrical signal output from the imaging device and conducts A/D conversion. The second imaging device 116*b* generates and outputs an input image by capturing the back surface of the conveyed medium under the control of the processing circuitry described below.

The medium conveying apparatus 100 may include one of the first imaging device 116*a* and the second imaging device 116*b* and may read one side of the medium. Instead of the line sensor using the CIS of same-magnification optics type including the CMOS imaging device, a line sensor using a CIS of same-magnification optics type including a charge coupled device (CCD) imaging device may be used. A line sensor of reduced optics type including a CMOS or CCD imaging device may also be used.

The first discharge roller 117 and the second discharge roller 118 are located downstream of the imaging device 116, opposed to each other, and discharge the medium conveyed by the first conveyance roller 114 and the second conveyance roller 115 and captured by the imaging device 116 to the discharge tray 105.

The medium placed on the placement tray 103 is conveyed between the lower guide surface 101*a* and the upper guide surface 102*a* toward the medium conveying direction A1 when the feed roller 112 rotates in the direction of arrow A6 in FIG. 10, i.e., the medium feeding direction. The separation roller 113 rotates in the direction of arrow A7, i.e., the direction opposite to the medium feeding direction, during media feeding. Because of the actions of the feed roller 112 and the separation roller 113, when a plurality of media is placed on the placement tray 103, the medium in contact with the feed roller 112 among the media placed on the placement tray 103 is separated. This restricts the conveyance of media other than the separated medium (prevention of overlapped feeding).

The medium is fed between the first conveyance roller 114 and the second conveyance roller 115 while being guided by the lower guide surface 101*a* and the upper guide surface 102*a*. The medium is fed between the first imaging device 116*a* and the second imaging device 116*b* when the first conveyance roller 114 and the second conveyance roller 115 rotate in the directions of arrows A8 and A9, respectively. The medium read by the imaging device 116 is discharged to the discharge tray 105 when the first discharge roller 117 and the second discharge roller 118 rotate in the directions of arrows A10 and A11, respectively.

Figure 11:
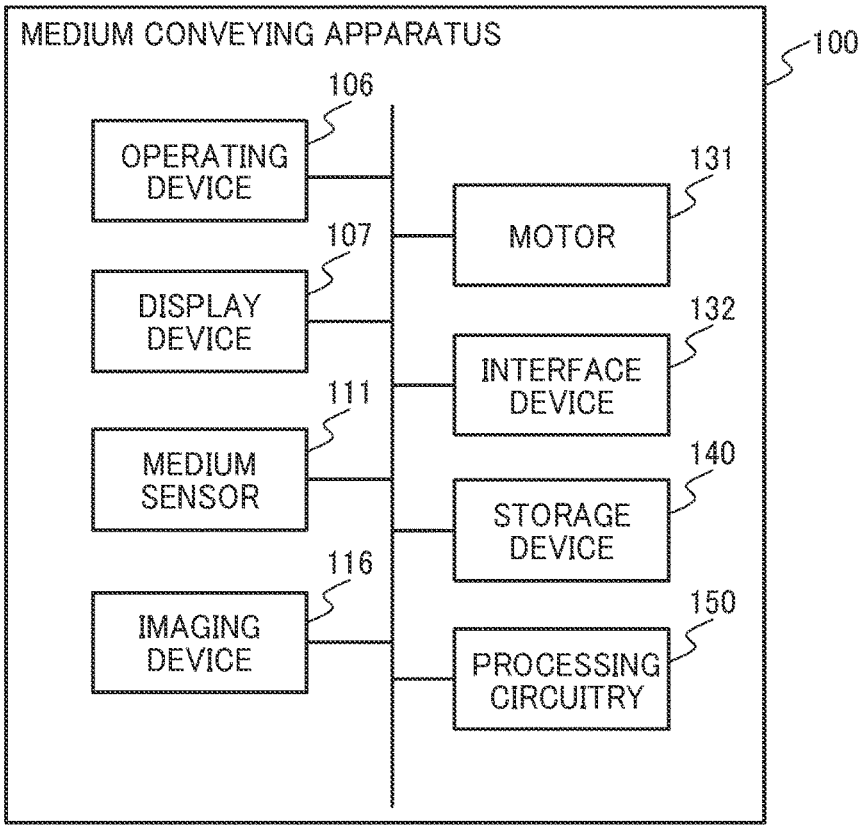
FIG. 11 is a block diagram illustrating a schematic configuration of the medium conveying apparatus illustrated in FIG. 1.

FIG. 11 is a block diagram illustrating a schematic configuration of the medium conveying apparatus 100.

In addition to the above-described configuration, the medium conveying apparatus 100 further includes a motor 131, an interface device 132, a storage device 140, and processing circuitry 150.

The motor 131 includes one or more motors and, according to control signals from the processing circuitry 150, rotates the feed roller 112, the separation roller 113, the first conveyance roller 114, the second conveyance roller 115, the first discharge roller 117, and the second discharge roller 118 to convey a medium. One of the first conveyance roller 114 and the second conveyance roller 115 may be a driven roller that is driven and rotated by the other roller. One of the first discharge roller 117 and the second discharge roller 118 may be a driven roller that is driven and rotated by the other roller.

The interface device 132 includes an interface circuit equivalent to a serial bus, such as a Universal Serial Bus (USB), and is electrically connected to an information processing device (e.g., personal computer, or portable information terminal) to transmit and receive input images and various types of information. Instead of the interface device 132, a communication unit may be used, which includes an antenna that transmits and receives wireless signals and a wireless communication interface device that transmits and receives signals through a wireless communication line according to a predetermined communication protocol. The predetermined communication protocol is, for example, a wireless local area network (LAN). The communication unit may include a wired communication interface device that transmits and receives signals through a wired communication line according to a communication protocol such as a wired LAN.

The storage device 140 includes a memory device such as a random access memory (RAM) or a read only memory (ROM), a fixed disk device such as a hard disk, or a portable storage device such as a flexible disk or an optical disk. The storage device 140 stores computer programs, databases, tables, etc. used for various processes of the medium conveying apparatus 100. The computer program may be installed from a portable computer-readable recording medium to the storage device 140 by using a known setup program, etc. The portable recording medium is, for example, a compact disc read only memory (CD-ROM) and a digital versatile disc read only memory (DVD-ROM).

The processing circuitry 150 operates based on a program previously stored in the storage device 140. The processing circuitry is, for example, a central processing unit (CPU). A digital signal processor (DSP), large scale integration (LSI), an application specific integrated circuit (ASIC), a field-programmable gate array (FPGA), or the like, may be used as the processing circuitry 150.

The processing circuitry 150 is connected to the operating device 106, the display device 107, the medium sensor 111, the imaging device 116, the motor 131, the interface device 132, the storage device 140, etc., to control each of these units. Based on the medium signal received from the medium sensor 111, the processing circuitry 150 controls the drive of the motor 131, controls the image capture of the imaging device 116, etc., acquires input images from the imaging device 116, and transmits the input images to the information processing device via the interface device 132.

Figure 12:
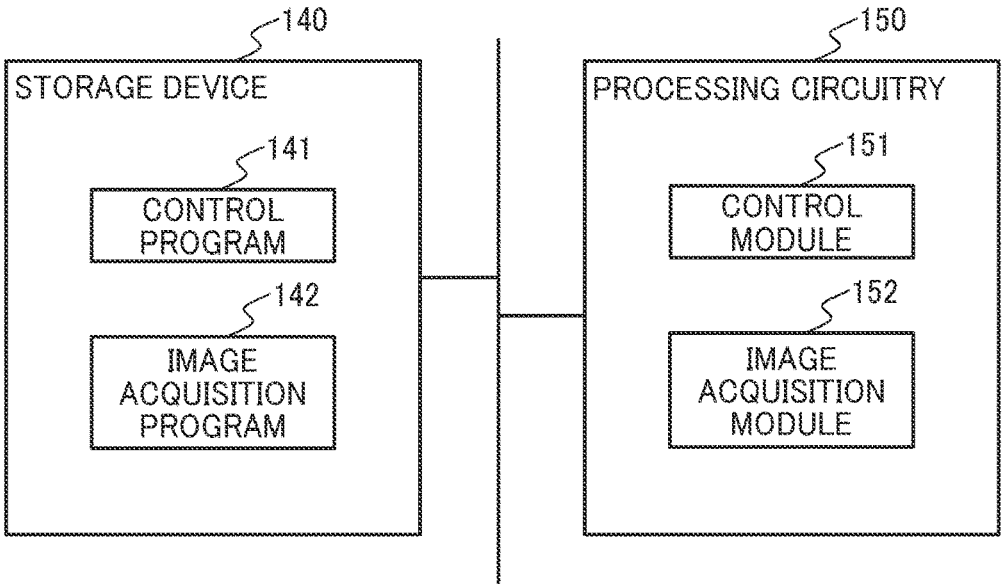
FIG. 12 is a diagram illustrating a schematic configuration of a storage device and processing circuitry illustrated in FIG. 11.

FIG. 12 illustrates schematic configurations of the storage device 140 and the processing circuitry 150.

As illustrated in FIG. 12, the storage device 140 stores a control program 141, an image acquisition program 142, etc. Each of these programs is a functional module implemented by software running on a processor. The processing circuitry 150 reads each program stored in the storage device 140 and operates in accordance with each read program. Thus, the processing circuitry 150 functions as a control module 151 and an image acquisition module 152.

Figure 13:
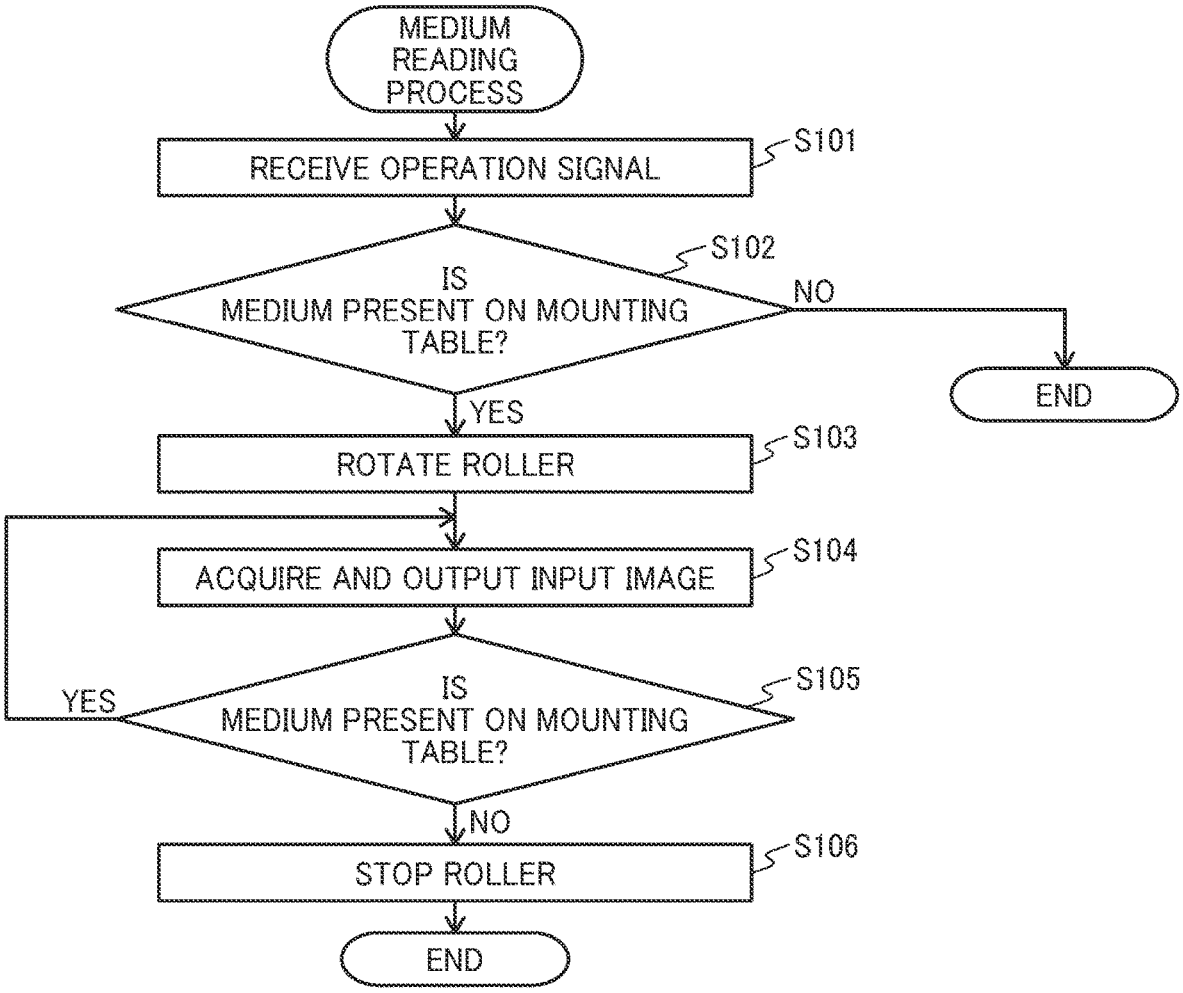
FIG. 13 is a flowchart of an operation of a medium reading process according to an embodiment of the present disclosure.

FIG. 13 is a flowchart illustrating an example of an operation of a medium reading process of the medium conveying apparatus 100.

An example of the operation of the medium reading process of the medium conveying apparatus 100 will be described below with reference to the flowchart illustrated in FIG. 13. The flow of the operation described below is performed primarily by the processing circuitry 150 in cooperation with each element of the medium conveying apparatus 100 based on a program previously stored in the storage device 140.

First, the control module 151 waits until an instruction to read the medium is input by the user using the operating device 106 or the information processing device and an operation signal indicating the reading of the medium is received from the operating device 106 or the interface device 132 (step S101).

Subsequently, the control module 151 acquires a medium signal from the medium sensor 111 and, based on the acquired medium signal, determines whether a medium is present on the placement tray 103 (step S102). When no medium is present on the placement tray 103, the control module 151 terminates the series of steps.

Conversely, when a medium is present on the placement tray 103, the control module 151 rotates the feed roller 112, the separation roller 113, the first conveyance roller 114, the second conveyance roller 115, the first discharge roller 117, and/or the second discharge roller 118 (step S103). The control module 151 drives the motor 131 to rotate each roller and convey the medium.

Subsequently, the control module 151 causes the imaging device 116 to capture the medium, acquires an input image from the imaging device 116, and transmits the acquired input image to the information processing device via the interface device 132 to output the input image (step S104).

Subsequently, the control module 151 determines whether a medium remains on the placement tray 103 based on the medium signal received from the medium sensor 111 (step S105). When a medium remains on the placement tray 103, the control module 151 returns the process to Step S104 and repeats the process of Steps S104 and S105.

Conversely, when no medium remains on the placement tray 103, the control module 151 stops the feed roller 112, the separation roller 113, the first conveyance roller 114, the second conveyance roller 115, the first discharge roller 117, and/or the second discharge roller 118 (step S106). The control module 151 controls the motor 131 to stop each roller and terminates the series of steps.

As described in detail above, in the medium conveying apparatus 100, the placement tray 103 is provided such that the placement tray 103 is inserted into the lower housing 101 in an inclined state, and the downstream end 104*a* of the side guide 104 is not in contact with the lower guide surface 101*a* when the placement tray 103 is inclined. Thus, the medium conveying apparatus 100 allows the detachable placement tray 103 to be set in a desirable manner and allows the medium to be guided in a desirable manner.

In particular, the medium conveying apparatus 100 allows the user to easily set the placement tray 103 in the lower housing 101 without using complicated operations and excessive insertion force. Similarly, in the medium conveying apparatus 100, the user may easily detach the placement tray 103 while not in use for compact storage and at the time of occurrence of a medium jam for easy recovery.

The medium conveying apparatus 100 may prevent the occurrence of damages to the placement tray 103 when the user accidentally hits his/her hand on the medium conveying apparatus 100 during a user operation such as carrying the medium conveying apparatus 100 or setting a medium on the placement tray 103. In particular, the placement tray 103 is provided such that the placement tray 103 can be detached when inclined upward. Therefore, the medium conveying apparatus 100 may prevent the placement tray 103 from falling down and getting damaged when a downward force is applied to set a medium on the placement tray 103, or when a force is applied to the placement tray 103 in a direction parallel to the lower guide surface 101*a*.

Figure 14:
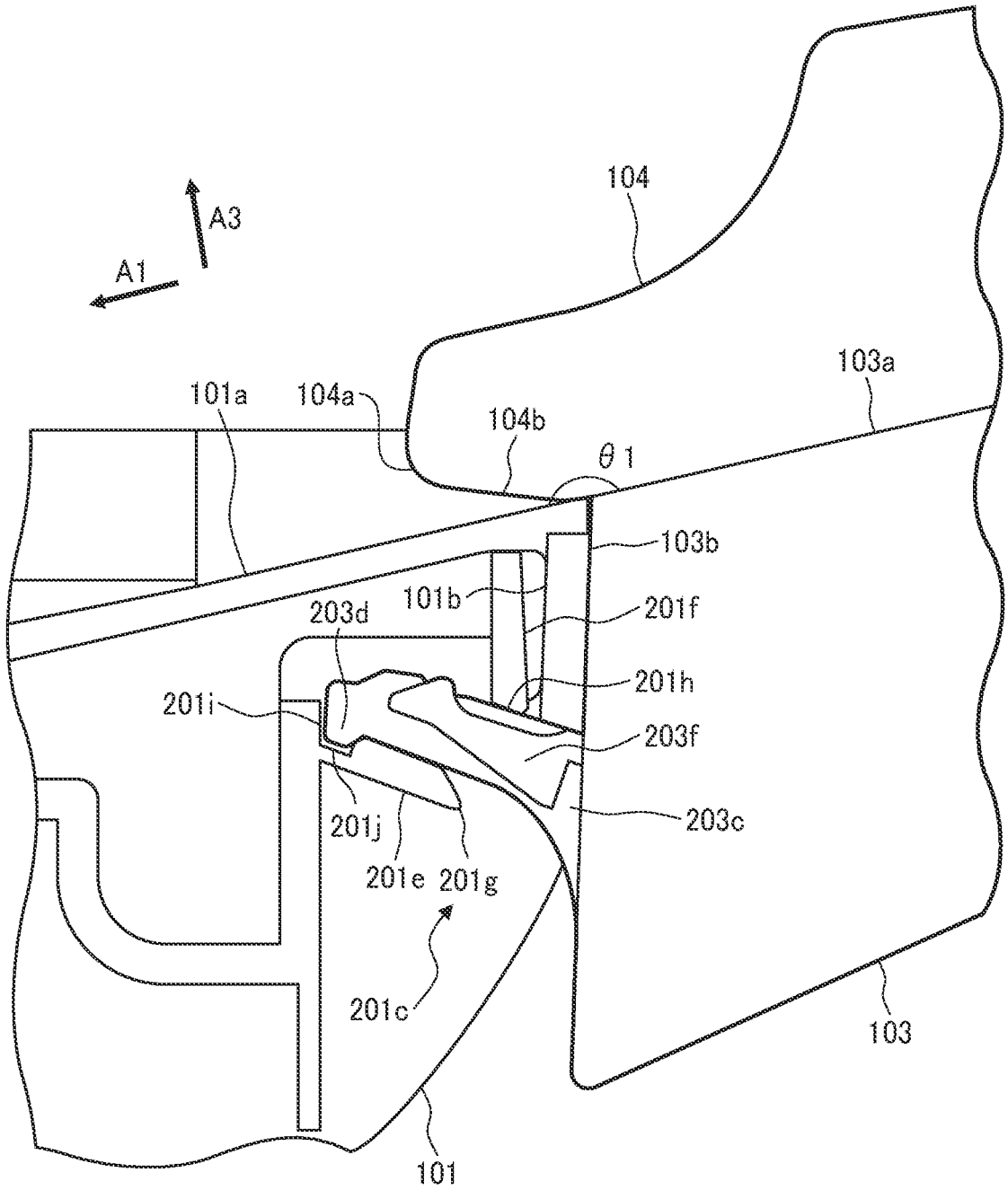
FIG. 14 is a schematic view of an engaged portion according to another embodiment of the present disclosure.
Figure 15:
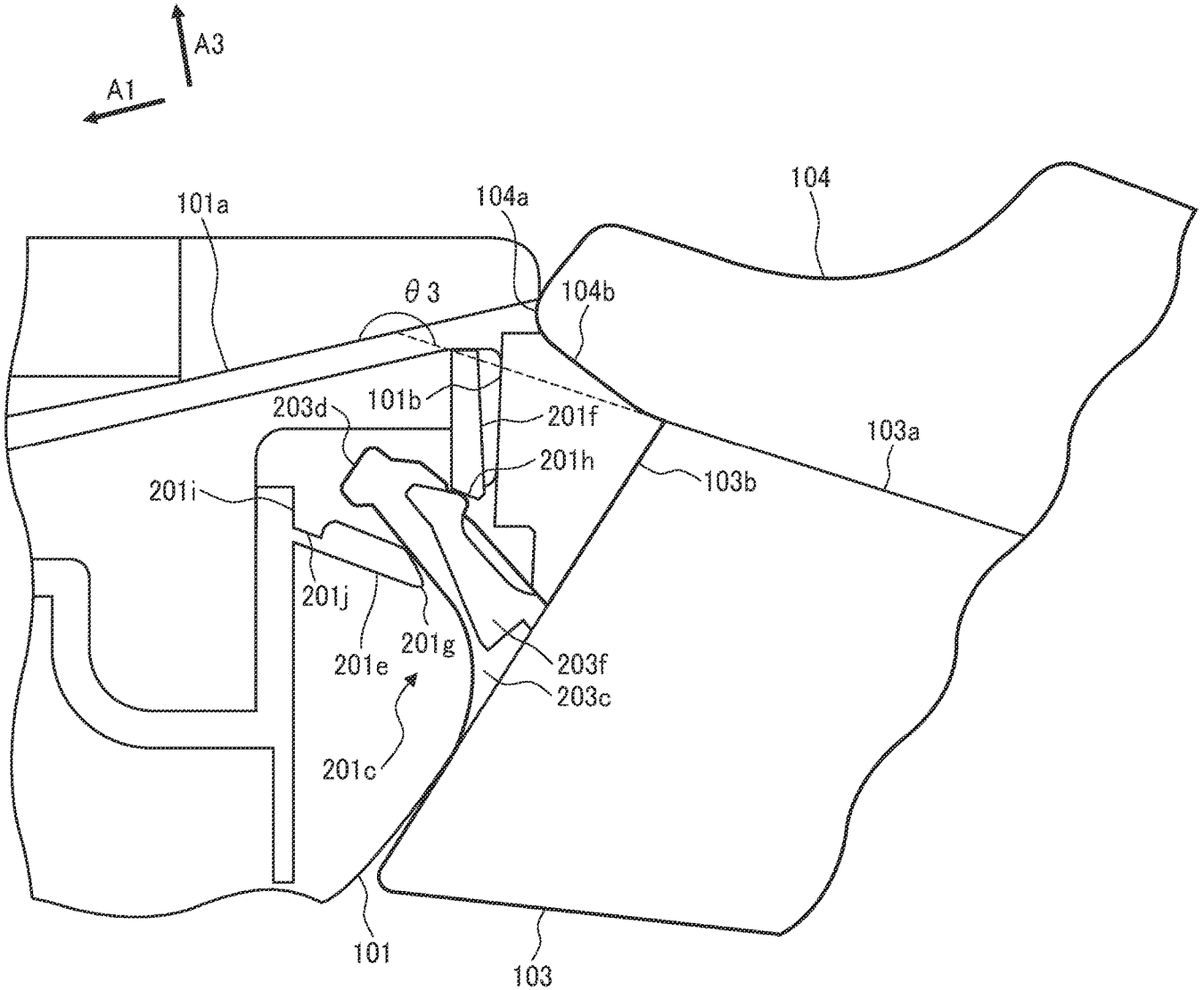
FIG. 15 is a schematic view of the engaged portion illustrated in FIG. 14.

FIGS. 14 and 15 are schematic views illustrating an engaged portion 201*c* and an engaging portion 203*c* in a medium conveying apparatus according to another embodiment. FIGS. 14 and 15 are cross-sectional views of an area around the engaged portion 201*c* and the engaging portion 203*c* when viewed from the side.

As illustrated in FIGS. 14 and 15, in the medium conveying apparatus according to the present embodiment, the downstream surface 103*b* of the placement tray 103 includes the engaging portion 203*c* instead of the engaging portion 103*c*. The upstream surface 101*b* of the lower housing 101 includes the engaged portion 201*c* that is engageable with the engaging portion 203*c* instead of the engaged portion 101*c*.

The engaging portion 203*c* has a similar configuration to that of the engaging portion 103*c*. However, the engaging portion 203*c* protrudes from the downstream surface 103*b* such that the downstream side thereof is located at an upper position, and the downstream end 203*d* of the engaging portion 203*c* is formed to protrude downward. An elastic claw portion 203*f* is provided inside the engaging portion 203*c*.

The engaged portion 201*c* has a similar configuration to that of the engaged portion 101*c*. However, the engaged portion 201*c* includes a first engaged portion 201*e* and a second engaged portion 201*f*. The first engaged portion 201*e* is provided below the engaging portion 203*c*, which is located in the engaged portion 201*c*, to extend substantially parallel to the extending direction of the engaging portion 203*c*. A downstream end of the first engaged portion 201*e* includes a wall portion 201*i* and a recessed portion 201*j*. The second engaged portion 201*f* is provided above the engaging portion 203*c*, which is located in the engaged portion 201*c*, to extend substantially parallel to the height direction A3. The first engaged portion 201*e* and the second engaged portion 201*f* form an entrance for the engaging portion 203*c* into the engaged portion 201*c*. An upstream end 201*g* of the first engaged portion 201*e* is positioned downstream of and below a lower end 201*h* of the second engaged portion 201*f*, and therefore the entrance is formed to open upstream and downward.

As illustrated in FIG. 14, when the downstream end 203*d* of the engaging portion 203*c* abuts the wall portion 201*i* and is fitted into the recessed portion 201*j*, the engaging portion 203*c* is engaged with the engaged portion 201*c*. However, as the placement tray 103 is supported by the lower housing 101 with the downstream end 203*d* and the recessed portion 201J, the stability of the placement tray 103 according to the present embodiment is lower than that of the placement tray 103 of the medium conveying apparatus 100.

The placement surface 103*a* of the placement tray 103 is positioned to form the first angle θ1 with the lower guide surface 101*a* of the lower housing 101 when the placement tray 103 is fixed to the lower housing 101. The engaged portion 201*c* restricts entry or removal of the engaging portion 203*c* when the placement surface 103*a* forms the first angle θ1 with the lower guide surface 101*a* in attachment of the placement tray 103 to the lower housing 101 or detachment of the placement tray 103 from the lower housing 101.

On the other hand, in the state illustrated in FIG. 15, the placement surface 103*a* and the lower guide surface 101*a* are positioned to form a second angle θ3 that is different from the first angle θ1. The second angle θ3 is larger than the first angle θ1 and is set, for example in the range from 210° to 240°. As illustrated in FIG. 15, the engaged portion 201*c* allows entry or removal of the engaging portion 203*c* when the placement surface 103*a* forms the second angle θ3 with the lower guide surface 101*a* in attachment of the placement tray 103 to the lower housing 101 or detachment of the placement tray 103 from the lower housing 101.

As described in detail above, in the medium conveying apparatus, even when the second angle θ3 is set to be larger than the first angle θ1, it is possible to set the detachable placement tray 103 in a desirable manner and guide the medium in a desirable manner.

Figure 16:
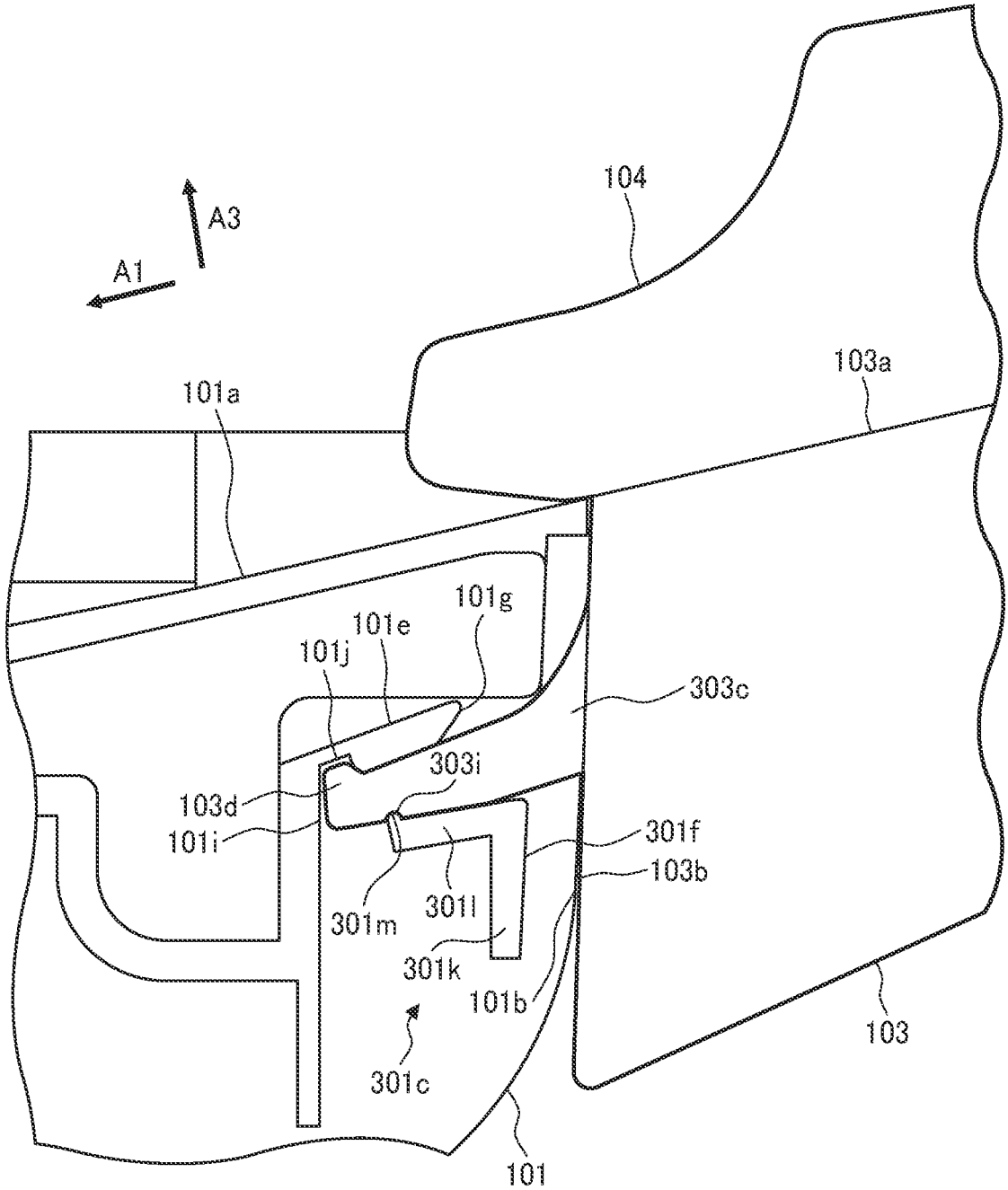
FIG. 16 is a schematic view of an engaged portion according to still another embodiment of the present disclosure.
Figure 17:
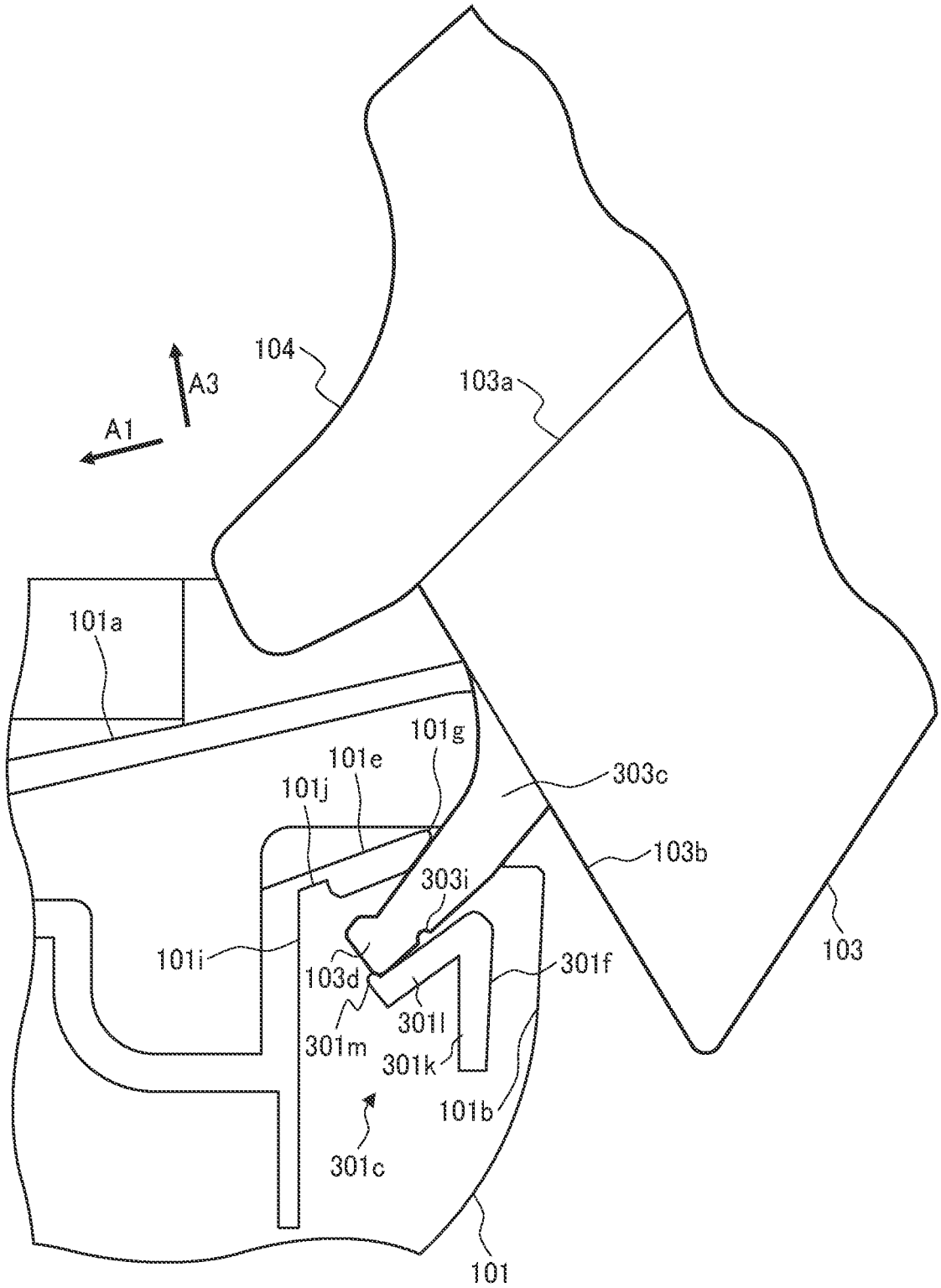
FIG. 17 is a schematic view of the engaged portion illustrated in FIG. 16.

FIGS. 16 and 17 are schematic views illustrating an engaged portion 301*c* and an engaging portion 303*c* in a medium conveying apparatus according to further another embodiment. FIGS. 16 and 17 are cross-sectional views of an area around the engaged portion 301*c* and the engaging portion 303*c* when viewed from the side.

As illustrated in FIGS. 16 and 17, in the medium conveying apparatus according to the present embodiment, the downstream surface 103*b* of the placement tray 103 includes the engaging portion 303*c* instead of the engaging portion 103*c*. The upstream surface 101*b* of the lower housing 101 includes the engaged portion 301*c* that is engageable with the engaging portion 303*c* instead of the engaged portion 101*c*.

The engaging portion 303*c* has a similar configuration to that of the engaging portion 103*c*. However, the elastic claw portion 103*f* is not provided in the engaging portion 303*c* and, instead, a recessed portion 303*i* is provided on a lower surface of the engaging portion 303*c*.

The engaged portion 301*c* has a similar configuration to that of the engaged portion 101*c*. However, the engaged portion 301*c* includes a second engaged portion 301*f* instead of the second engaged portion 101*f*. The second engaged portion 301*f* includes a first surface 301*k* and a second surface 301*l*. The first surface 301*k* and the second surface 301*l* located in the engaged portion 301*c* are provided below the engaging portion 303*c*. The first surface 301*k* and the second surface 301*l* are provided to extend substantially parallel to the height direction A3 and the extending direction of the engaging portion 303*c*, respectively, and have an L-shape. The second surface 301*l* is elastic and is swingable with an upstream end connected to the first surface 301*k* as a swing axis. The second surface 301*l* swings downward when pressed from above by the engaging portion 303*c*. A downstream end 301*m* of the second surface 301*l* is formed to protrude upward.

As illustrated in FIG. 17, when the placement tray 103 is attached to or detached from the lower housing 101, the engaging portion 303*c* enters or is removed from the engaged portion 301*c* in an inclined state. While the engaging portion 303*c* moves along the second surface 301*l*, the second surface 301*l* is pushed down by the engaging portion 303*c*. When the placement tray 103 is attached to the lower housing 101, the recessed portion 303*i* on the lower surface of the engaging portion 303*c* moves to the position opposed to the downstream end 301*m* of the second engaged portion 301*f* and engages with the end portion 301*m*, as illustrated in FIG. 16.

The user may feel that the engaging portion 303*c* has engaged with the engaged portion 301*c* by the vibration that occurs when the engaging portion 303*c* enters the engaged portion 301*c* and the end portion 301*m* engages with the recessed portion 303*i*. This allows the medium conveying apparatus to prevent the user from terminating the insertion operation of the placement tray 103 while the placement tray 103 is not completely inserted into the lower housing 101 and thus prevent the occurrence of damages to the placement tray 103 due to falling, etc.

As described in detail above, in the medium conveying apparatus, even when the engaged portion 301*c* on the lower housing 101 side has elasticity, it is possible to set the detachable placement tray 103 in a desirable manner and to guide the medium in a desirable manner.

Figure 18:
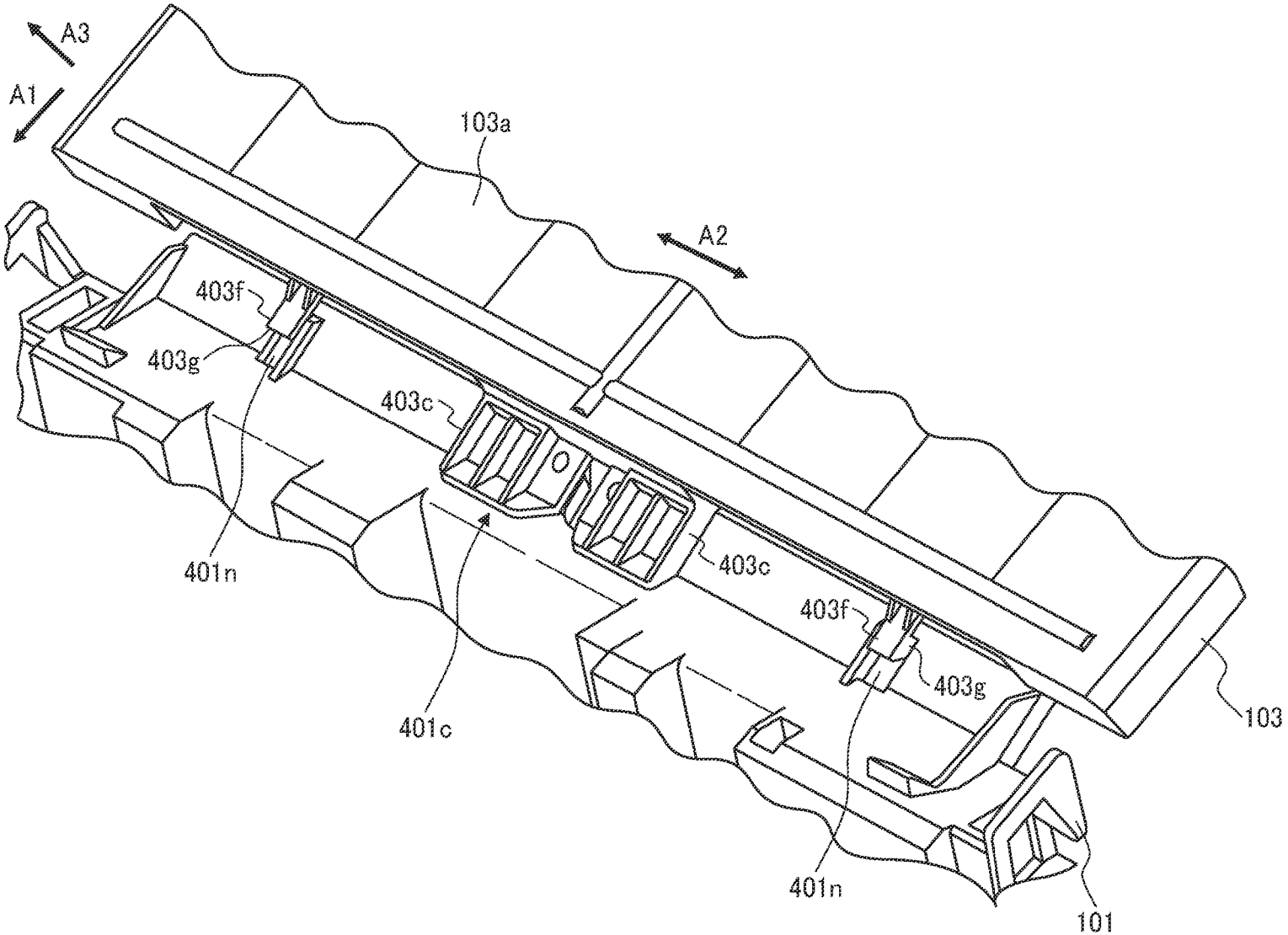
FIG. 18 is a schematic view of an engaged portion according to yet another embodiment of the present disclosure.

FIG. 18 is a schematic view illustrating an engaged portion 401*c* and an engaging portion 403*c* in a medium conveying apparatus according to further another embodiment. FIG. 18 is a cross-sectional view of the inside of the engaged portion 401*c* when viewed from above.

As illustrated in FIG. 18, in the medium conveying apparatus according to the present embodiment, the placement tray 103 includes an engaging portion 403*c* instead of the engaging portion 103*c*. Instead of the engaged portion 101*c*, the lower housing 101 includes an engaged portion 401*c* that is engageable with the engaging portion 403*c*.

The engaging portion 403*c* has a similar configuration to that of the engaging portion 103*c*. However, the elastic claw portion 103*f* is not provided inside the engaging portion 403*c*, and instead, an elastic claw portion 403*f* is provided on the outer side of the engaging portion 403*c*. The claw portion 403*f* has an upstream end positioned on the downstream surface of the placement tray 103 and is swingable with the upstream end portion as a swing axis. A lower surface 403*g* of the claw portion 403*f* is formed to protrude downward. The claw portion 403*f* swings upward when the lower surface 403*g* is pressed upward.

The engaged portion 401*c* has a similar configuration to that of the engaged portion 101*c*. The lower housing 101 includes a receiving portion 401*n* that is engaged with the claw portion 403*f* on the outer side of the engaged portion 401*c*.

The user may feel that the engaging portion 403*c* has engaged with the engaged portion 401*c* by the vibration occurs when the engaging portion 403*c* of the placement tray 103 enters the engaged portion 401*c* of the lower housing 101 and the claw portion 403*f* engages with the receiving portion 401*n*. This allows the medium conveying apparatus to prevent the user from terminating the insertion operation of the placement tray 103 while the placement tray 103 is not completely inserted into the lower housing 101 and thus prevent the occurrence of damages to the placement tray 103 due to falling, etc.

As described in detail above, in the medium conveying apparatus, even when the claw portion 403*f* is provided on the outer side of the engaging portion 403*c*, it is possible to set the detachable placement tray 103 in a desirable manner and to guide the medium in a desirable manner.

Figure 19:
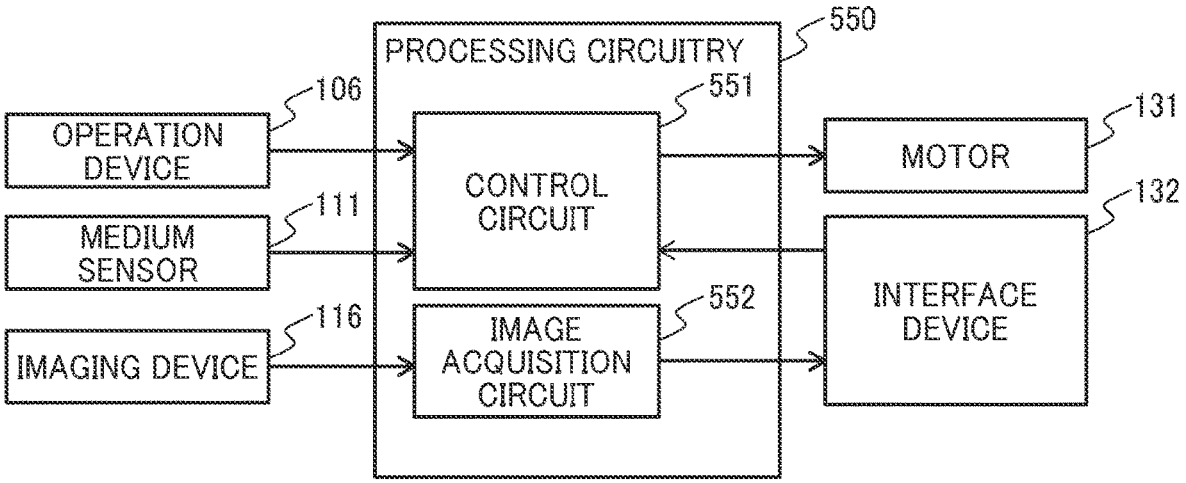
FIG. 19 illustrates a schematic configuration of processing circuitry according to another embodiment of the present disclosure.

FIG. 19 illustrates a schematic configuration of processing circuitry 550 in a medium conveying apparatus according to further another embodiment. The processing circuitry 550 is used instead of the processing circuitry 150 of the medium conveying apparatus 100 and executes a medium reading process, and the like, instead of the processing circuitry 150. The processing circuitry 550 includes a control circuit 551, an image acquisition circuit 552, etc. Each of these components may be formed of an independent integrated circuit, a microprocessor, firmware, etc.

The control circuit 551 is an example of a control module and has a similar function to that of the control module 151. The control circuit 551 receives operation signals from the operating device 106 or the interface device 132 and medium signals from the medium sensor 111. The control circuit 551 controls the motor 131 based on each piece of information received.

The image acquisition circuit 552 is an example of an image acquisition module and has a similar function to that of the image acquisition module 152. The image acquisition circuit 552 acquires input images from the imaging device 116 and outputs the input images to the interface device 132.

As described in detail above, in the medium conveying apparatus, even when the processing circuitry 550 is used, it is possible to set the detachable placement tray 103 in a desirable manner and to guide the medium in a desirable manner.

Although the above is a description of suitable embodiments, embodiments are not limited to these embodiments. For example, in a medium conveying apparatus, the engaged portion on the upstream surface 101*b* of the lower housing 101 may have a projection shape that protrudes from the side surface 101*b*, and the engaging portion on the downstream surface 103*b* of the placement tray 103 may have a recessed shape. In this case, too, the engaging portion and the engaged portion are engaged with each other, and the placement tray 103 is supported by the lower housing 101.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The invention claimed is:

1. A medium conveying apparatus, comprising:

a housing having an engaged portion and a guide surface for media;

a placement tray attachable to and detachable from the housing and having an engaging portion engageable with the engaged portion and a placement surface for media, wherein when fixed to the housing, the placement tray forms a first angle with the guide surface; and a side guide mounted on the placement surface and protruding downstream beyond the placement tray in a medium conveying direction to restrict a medium in a width direction perpendicular to the medium conveying direction, wherein the engaged portion is configured to:

restrict entry or removal of the engaging portion when the placement surface forms the first angle with the guide surface in attachment of the placement tray to the housing or detachment of the placement tray from the housing; and allow entry or removal of the engaging portion when the placement surface forms a second angle different from the first angle with the guide surface in attachment of the placement tray to the housing or detachment of the placement tray from the housing, and wherein a downstream end of the side guide in the medium conveying direction does not intersect with the guide surface as viewed from the width direction when the placement surface forms the second angle with the guide surface in attachment of the placement tray to the housing or detachment of the placement tray from the housing.

2. The medium conveying apparatus according to claim 1, wherein an entrance into the engaged portion of the housing has a shape that allows entry or removal of the engaging portion when the placement surface and the guide surface form the second angle and prevents entry or removal of the engaging portion when the placement surface and the guide surface form an angle outside a predetermined range with respect to the second angle.

3. The medium conveying apparatus according to claim 1, wherein a length by which the engaging portion protrudes downstream beyond the placement surface in the medium conveying direction is longer than a length by which the downstream end of the side guide protrudes downstream beyond the placement surface in the medium conveying direction.

4. The medium conveying apparatus according to claim 1, wherein the placement surface and the guide surface are flush when the placement tray is fixed to the housing.

5. The medium conveying apparatus according to claim 1, wherein the second angle is smaller than the first angle.

6. The medium conveying apparatus according to claim 1, wherein when a projection portion of one of the engaging portion and the engaged portion is engaged with a recessed portion of the other of the engaging portion and the engaged portion, the placement tray is positioned with respect to the housing in the width direction perpendicular to the medium conveying direction.

* * * * *